United States Patent [19]

Teague

[11] Patent Number: 4,658,995

[45] Date of Patent: Apr. 21, 1987

[54] SOCK BOARDING METHOD AND APPARATUS

[75] Inventor: Richard M. Teague, Taylorsville, N.C.

[73] Assignee: Anteg Incorporated, Hickory, N.C.

[21] Appl. No.: 816,102

[22] Filed: Jan. 3, 1986

[51] Int. Cl.[4] ..... D06C 5/00

[52] U.S. Cl. ..... 223/76; 223/112

[58] Field of Search ..... 223/76, 112; 68/5; 198/803

[56] References Cited

U.S. PATENT DOCUMENTS

| | | | |
|---|---|---|---|
| 1,126,619 | 1/1915 | Coulston et al. | 223/112 |
| 2,136,902 | 11/1938 | Griffin | 223/112 |
| 2,221,669 | 11/1940 | Brewin | 223/112 X |
| 3,312,332 | 4/1967 | Glaze | 223/76 X |
| 4,102,729 | 7/1978 | Annas, Sr. | 156/384 |
| 4,166,556 | 9/1979 | Annas, Sr. | 223/112 |
| 4,365,373 | 12/1982 | Witte et al. | 223/76 X |
| 4,524,889 | 6/1985 | Glaze | 223/76 |

*Primary Examiner*—Louis K. Rimrodt

*Attorney, Agent, or Firm*—Roy B. Moffitt

[57] ABSTRACT

An apparatus for drying and removing flaccid articles (socks) from boarding forms and stacking the flaccid articles in a layed out fashion comprising: an essentially enclosed heating chamber having first and second slit-like openings; first, second, third and fourth tracks for receiving, transporting and discharging a form carrier device, the first track is a continuous track disposed in the heating chamber and has at least one receiver and the second, third and fourth tracks are disposed outside of the heating chamber; the second track is aligned with the first slit and has a channel to receive a form carrier (on which a boarding form is disposed from the first track and transported it to the third track; the third track has a forked receiver device to receive a form carrier and transport it to the fourth track; the fourth track is aligned with the second slit and has a channel to receive a form carrier from the third track and discharge it through the second slit to the receiver of the first track; and, a flaccid article remover and a stacking device deposed outside of the heating chamber.

93 Claims, 51 Drawing Figures

FIG. 49
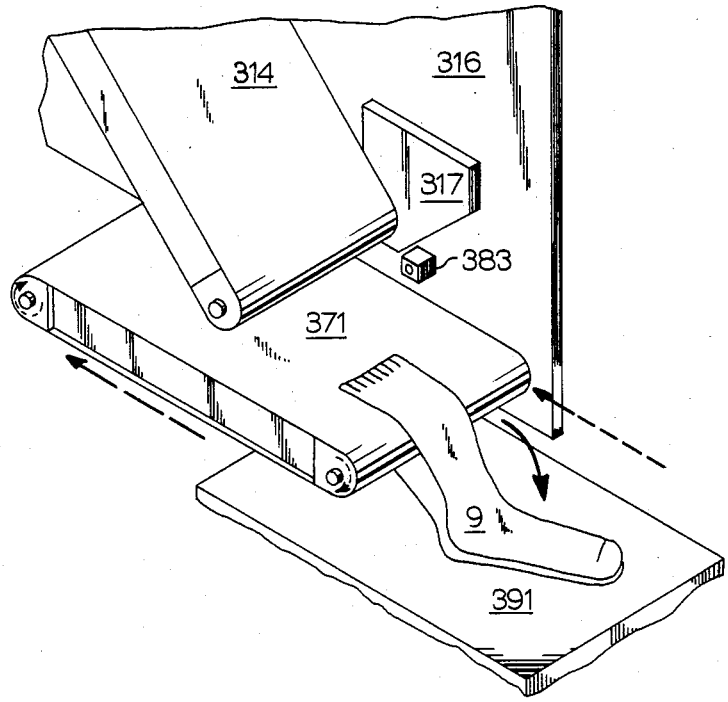
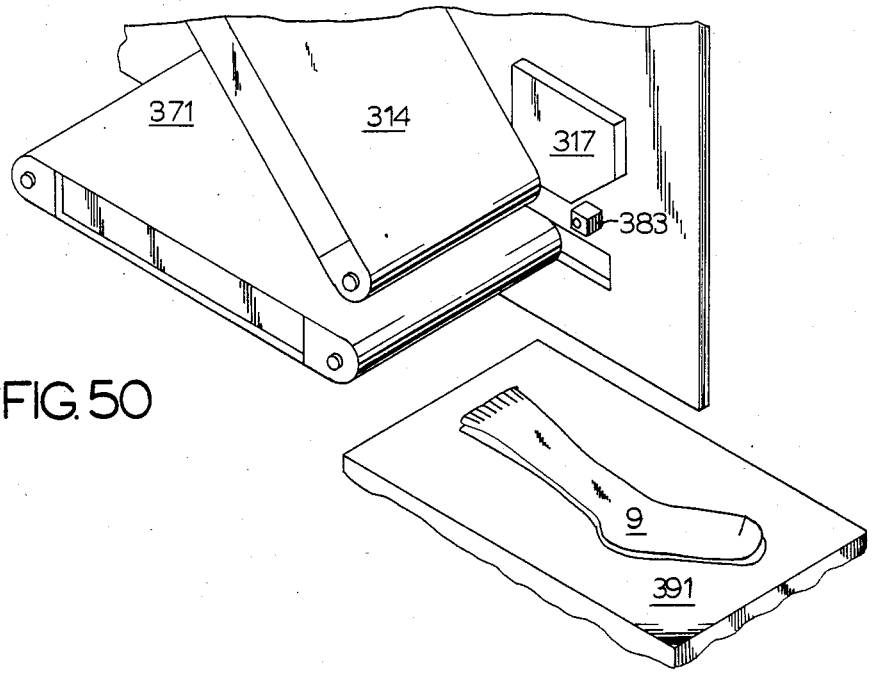
FIG. 50

SOCK BOARDING METHOD AND APPARATUS

BACKGROUND OF THE INVENTION

Flaccid articles (socks for example) are not easily handled in an automated process. After such articles are manufactured (usually knitted), they are put through a dyeing process, from which they emerge spunned dry (slightly wet) and in a crumpled heap. Thereafter, they are dried, formed and stacked in a laid out manner in preparation for rider attachment and ultimate packaging. It is towards the threefold problem associated with automating the drying, forming and stacking process that the present invention is directed.

The prior art has addressed this threefold problem, the most notable which are Coulston et al, U.S. Pat. No. 1,126,619; Griffin, U.S. Pat. No. 2,136,902 and Annas, Sr., U.S. Pat. No. 4,166,556. Exemplary of the prior art teachings is Annas which employs a plurality of upstanding internally heated forms to form and dry the socks as they come from the dyeing process. Annas uses a hexagonal shaped table with three upstanding heated forms affixed along side the terminal free edges of each of the six hexagonal sides. Such a structure mandates a complicated slip ring electrical circuit to supply heating current to the interior of each form as the forms are indexed (three at a time) into a position for stripping where socks are grasped by a grasping means (three at a time), stripped by a vertical upstanding frame to which the grasping means are affixed, thence moved in an upward and then afterwards in a downward and pivoting lateral fashion so that the frame comes to a halt in a horizontal position. At this instance, the grippers open, causing the articles to be deposited on a carrier.

There are two major drawbacks to this kind of apparatus: (1) the amount of electrical energy it consumes and (2) only tube socks (not socks having a heel and toe) may be processed. Because the machine operator must hand load the machine (put the socks on the form), the indexing table with its electrically heated forms are exposed to ambient conditions. Heat is wasted because the electrical forms are exposed. There is no way to solve this energy wasteful problem because the operator must have access to the forms in order to load them. It would be desirable if the waste heat coming off this machine could be recycled within an enclosed chamber.

In the Annas apparatus, the dried tube sock (tube sock only) is stripped from the upright form by grasping the sock (while it is still on the form) at opposite ends of the article, namely the welt and the toe regions. While in the thus grasped mode, the socks are traversed upward (to strip the article from the form) then laterally and simultaneously downwardly to a horizontal position and upon attaining this position, the grasping means are opened and the socks are deposited on a carrier means, a stacking operation. If for any reason, any one of the grasping means do not grasp and hold the socks as intended, the stacking operation is compromised. Experience has shown that even with the proper initial grasping, if one or more graspers fail to continuously hold the socks as it moves from its on form status to the horizontal pre-released state, stacking is compromised. This difficulty usually occurs after stripping but before deposition on the carrier.

In contrast to Annas, the present invention provides apparatus whereby a chamber is employed to simultaneously contain heat, dry, set and form socks (either tube or heel and toe type) disposed on a sock form.

Throughout this disclosure, the term ("flaccid articles") is used interchangeably with the word "sock(s)." Each sock or flaccid article form is removably connected to a separate form carrier that carries a sock on which the sock is traversed into and out of the heating chamber. The form carrier along with its individual sock form is transported out of the heating chamber to a stripping station, to a loading station and back into the heating chamber by means of series of interfacing tracks.

Instead of employing a plurality of graspers to simultaneously remove a plurality of socks from a like number of forms by grasping such socks at their opposite ends as does Annas, the present invention, strips socks (either tube or heel-toe type) from the forms one at a time, transports them to a tray, deposits them on the tray and then deposits the sock on a flat receiver in a stack until the flat receiver is covered with a layer of stacks of socks. Subsequently, the flat receiver is indexed 90°, lowered a predetermined distance (the height of a stack of socks) and then a second and like layer of sock stacks are deposited, at which time the flat receiver with its stacks of laid out socks is removed and then another flat receiver is provided and the process is repeated.

SUMMARY OF THE INVENTION

The invention comprises a sock boarding machine adapted for drying, forming, and removing socks from a form and stacking the socks in a laid out fashion utilizing a closed heating chamber having first and second slit-like openings. The slit-like openings are devised to allow upstanding sock forms (boarding forms on which the socks are disposed) to pass through the heating chamber sidewalls with a minimum loss of heat. Inside of the heating chamber is a continuous first track. Outside of the heating chamber are three other tracks and a sock removing and stacking device. At least one discreet form carrier having a tube-like member thereon adapted to receive and hold an upright sock boarding form is used in combination with the tracks inside and outside of the heating chamber. The first track is disposed in the heating chamber and has at least one (usually a plurality) of receivers attached to it. The second track is aligned with the first slit in the heating chamber, has a device (a channel formed of two elongated members spaced apart from one another, each having inwardly protruding protrusions) to receive a form carrier from the first track and transport it along the second track to the third track. The third track has a receiver that receives the form carrier from the second track and transport it along a path essesntially perpendicular to the longitudinal axis of the second track to a fourth track. The fourth track is aligned with the second slit in the heating chamber and has a channel to receive the form carrier from the third track, transport it along a path essentially perpendicular to the longitudinal axis of the third track and essentially parallel to the longitudinal axis of the second track through the second slit to a receiver of the first track in the heating chamber.

The flaccid article removing and stacking device (a remover) is composed of: (i) a grasper disposed above the sock forms, for grasping and removing a sock and is adapted to release the sock onto a continuous belt; (ii) a moving device associated with the grasper for moving the grasper from a first to a second position and then from the second to the first position at a predetermined rate; (iii) a continuous belt, adapted to be periodically rotated a predetermined distance disposed below the second position of the grasper for receiving and conveying the socks to a periodically reciprocating tray; (iv) a tray disposed beneath the continuous belt adapted to be reciprocated from a first (loaded) to a second (unloaded) position and then from the second to the first position, (v) a holder, attached to the tray, to "pin" a sock to a flat receiving means while the tray is being moved from the second to the first position to strip the sock from the tray; and (vi) a flat receiver disposed beneath the tray for receiving socks in stack-like fashion.

The flat receiver includes first, second, third and movers. The first mover is responsive to the deposition on the flat receiver of a single stack of socks. After a single stack is deposited, this first mover causes the flat receiver to move a predetermined horizontal distance essentially perpendicular to the longitudinal axis of the reciprocating tray. The second mover is responsive to the deposition on the flat receiving means of a predetermined number of stacks of socks to thereafter rotate the flat receiver 90°. The third mover is responsive to the vertical height and number of stacks of socks on the flat receiver to thereafter move the flat receiver downward a predetermined distance. The fourth mover is responsive to a predetermined vertical position of the flat receiver to remove power (deactivate) from the first, second, third and fourth tracks.

BRIEF DESCRIPTION OF THE DRAWINGS

FIGS. 49 and 50 are perspective views of the method steps used to transfer sock 9 from belt 371 to a receiver 391.

DETAILED DESCRIPTION OF THE INVENTION

Figure 1:
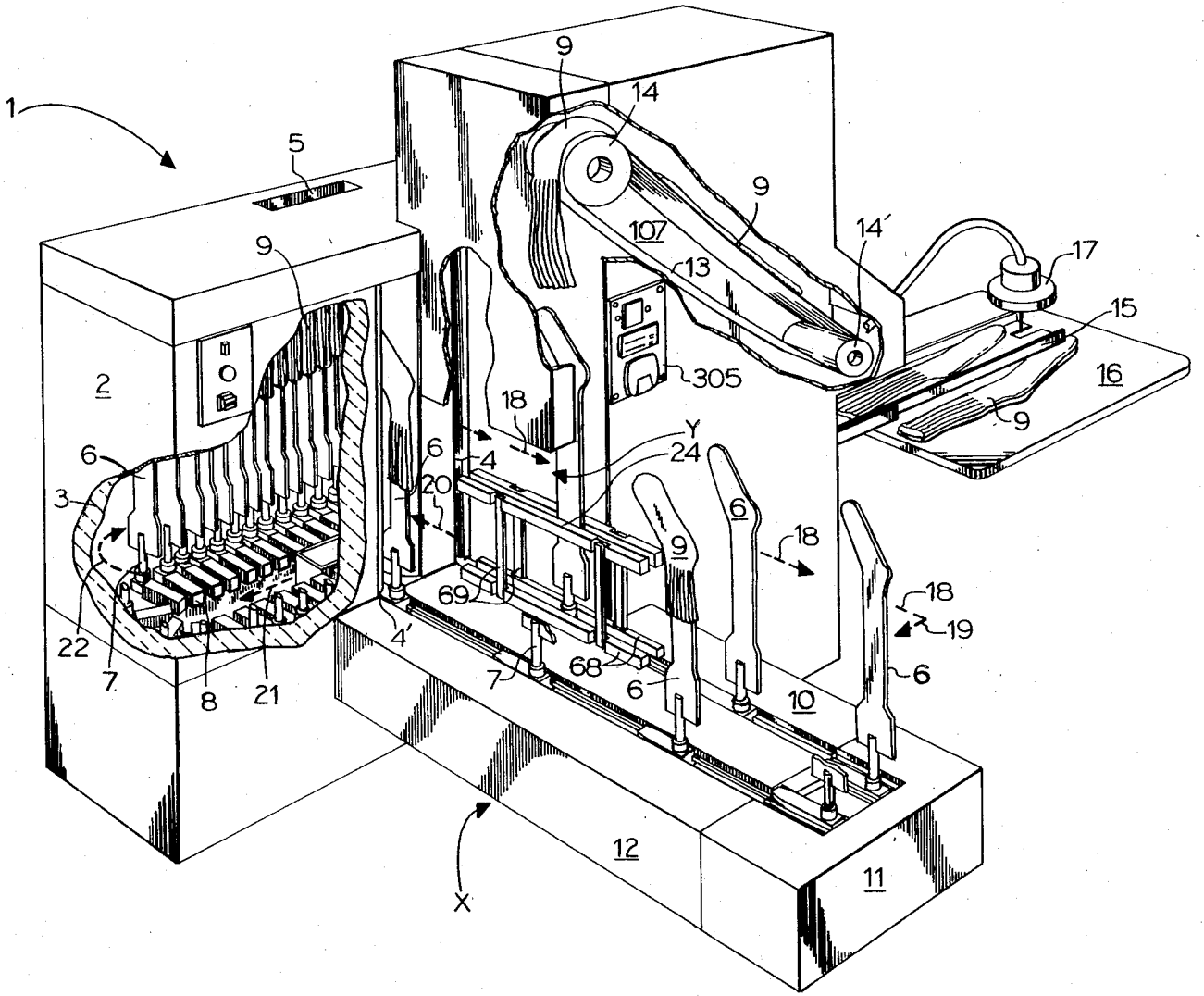
FIG. 1 is a perspective view of the preferred embodiment of the sock boarding apparatus of the invention showing a partial cutaway view of an enclosed heating chamber, a continous first track inside of the enclosed heater, boarding forms on the first track, diagramatic representations of second, third and fourth tracks outside of the heater, a continuous belt, sock remover tray and flat receiver.

Shown in FIG. 1 by element 1 is a perspective view of the preferred embodiment of the sock boarding apparatus of the present invention. Element 2 is an essentially enclosed heating chamber in which there is disposed a continuous chain 23 (FIG. 2) on which there is fastened a plurality of receivers 8. Continuous chain 23 is driven by sprockets 25—25' causing chain 23 to travel in an oblong circular path circumscribing conduit 67 through which hot air is forced from a hot air source (see FIG. 10). Heater 75 (FIG. 10) can be an oven heater sold under the mark Chromalox, Types OV and OVS manufactured by Emerson Electric Company. Chamber 2 is circumscribed (top, bottom and side walls) by insulating material 3 and one sidewall thereof has two upstanding slits 4 and 4' to provide ingress and egress for form carrying means 29.

Figure 3:
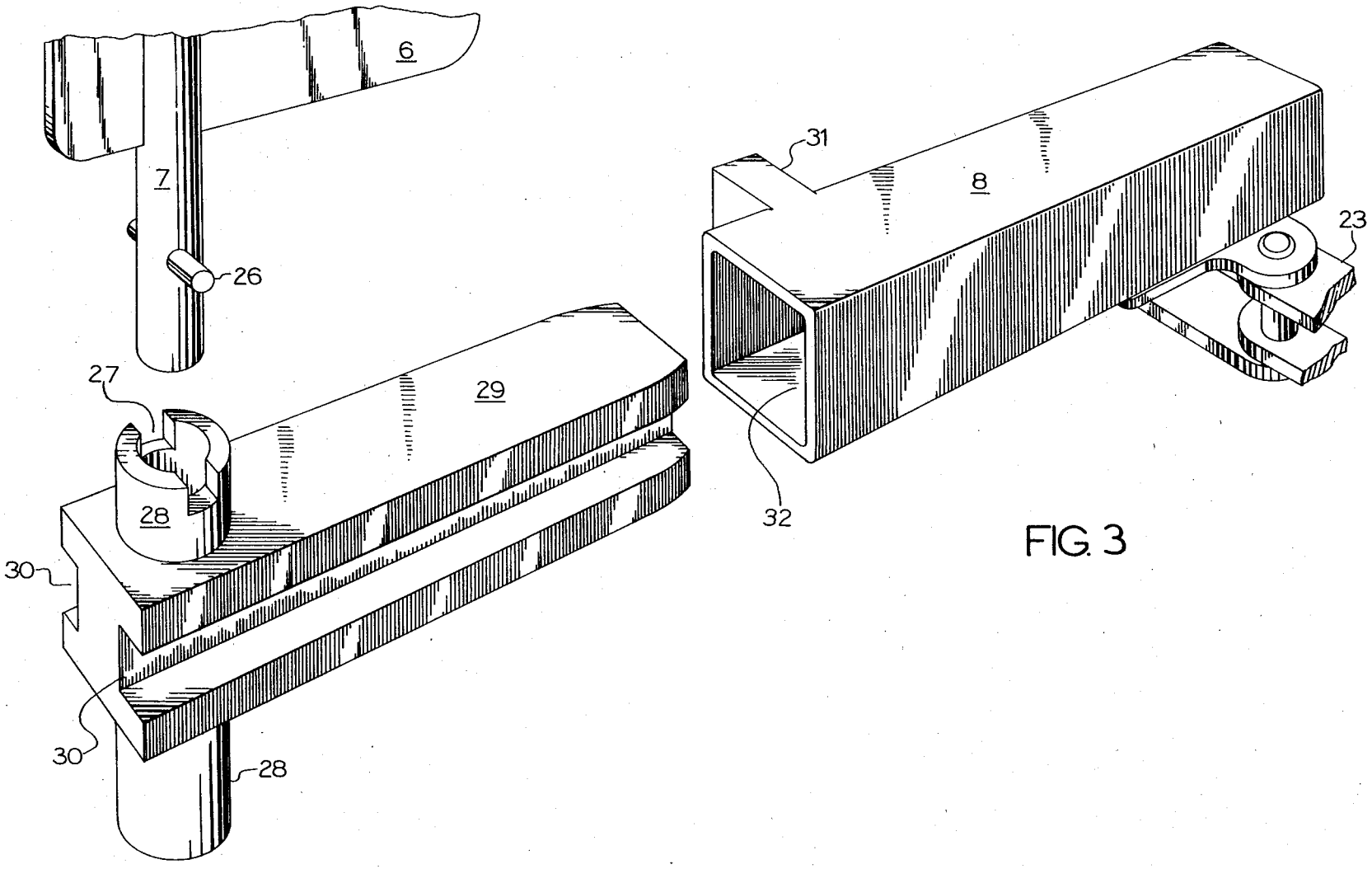
FIG. 3 is a partial perspective view of a form carrier, a receiver for receiving and transporting the form carrier and a fragmentary perspective view of the lowermost portion of a sock boarding form.

Receiver 8 (FIG. 3) includes lateral protrusion 31 and cavity 32 affixed to chain 23. Protrusion 31 is employed to keep one end of receiver 8 spaced apart from an adjacent receivers by predetermined distance, the lateral dimension of protrusion 31. The other end of element 8 is affixed to chain 23. Form carrier 29 (preferably made from a phenolic resin) is adapted to be inserted into cavity 32 of receiving means 8 up to the extent where upstanding tube 28 with slot 27 is disposed. Tube 28 protrudes through form carrier 29 and extends for a predetermined distance below the bottom of element 29. Form carrier 29 contains slots 30 disposed on its lateral sides parallel to its longitudinal axis. Element 7 is a rod having disposed in it cross member 26. Cross member 26 fits into slots 27, thereby causing rod 7 to be coaxially nested inside tubular means 28. Connected to rod 7 is a sock boarding form 6 onto which sock 9 may be either manually or automatically threaded on a terminal portion thereof.

Figure 8:
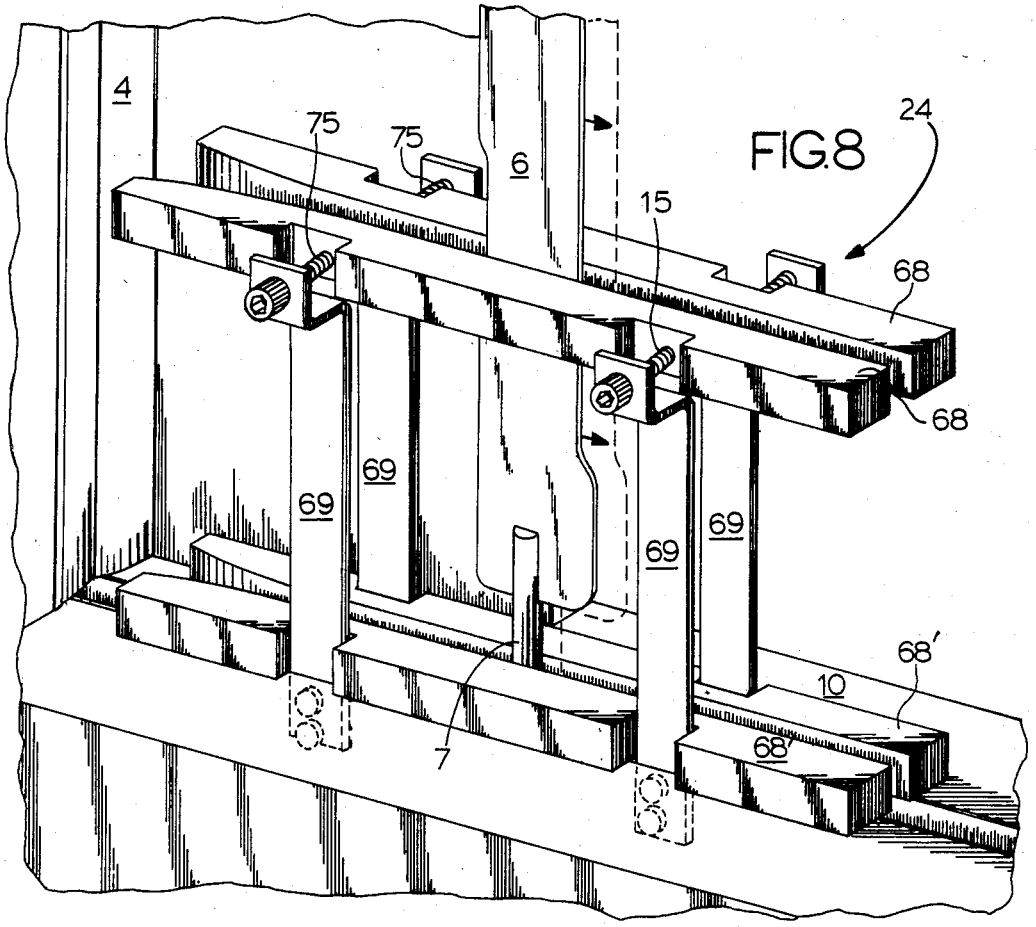
FIG. 8 is a partial perspective view of a sock boarding form guide of FIG. 1.

Form carrier 29 is adapted to be slideably received into cavity 32 and while so received, it and receiving means 8 are carried by chain 23 over a part of the path delimited by chain 23. See FIGS. 1–3. Sock 9, while threaded over a terminal portion of one of the sock boarding forms 6, travels over part of the path circumscribed by chain 23 in heating chamber 2 thus allowing the sock to "set" and dry. Form carrier 29 enters chamber 2 through slot 4' and leaves heating chamber 2 by slit 4 in a manner hereinafter described. Once form carrier 29 and receiver 8 have traversed the path described for it by chain 23 and comes in alignment with slit 4, element 29 is stripped from element 8, in a manner hereinafter described, placed in and traversed through track 10 causing sock boarding form 6 to pass through guide means 24. Element 24 (see FIG. 8) comprises two pairs of parallel disposed elongated members 68 and 68' spaced apart from track 10 by legs 69. From track 10, element 29 is transmitted to track 11, thence to track 12 and from track 12 through slit 4' back into a receiver 8 of heating chamber 2. The path just described is the same path as indicated by arrows 18, 19, 20, 21 and 22 respectively.

Outbound track 10 and inbound track 12 are of similar construction and for detail of their construction, reference is made to FIGS. 4, 5, 6 and 7. Both tracks contain opposingly disposed spaced apart elongated channels 33 and 33' each inwardly protruding, respectively each channel composed of upstanding sidewalls 35 each sidewall having laterally disposed spaced apart protrusions 34 adapted to be slideably received in slots 30 of form carrier 29. Disposed beneath channels 33 and 33' are continuous chain assemblies 40 and 40' respectively containing a plurality of upstanding dogs 41 and 41' respectively fixedly adhered thereto in a spaced apart predetermined manner. Dogs 41 are adapted to engage the bottommost terminal portion of tube 28 while form carrier 29 is still received in chain 32 of element 8, remove form carrier 29 from receiver 8, thread laterally and inwardly extending protrusions 34 of channel 33 into slots 30 of form carrier 29, transport same along the longitudinal axis of track 10, strip element 29 from protrusions 34 and thread element 29 onto the U-shaped members 39 of forked receiver 38 forming a part of track 11. The longitudinal axis of chains 40 and 40' are essentially perpendicular to the like axis of chain 51 of track 11.

Track 11 includes chain 51 threaded over guide 32, which is spaced apart from another guide 54. Both guides are used to guide the terminal portions of forked receiver 38. Element 38 is adapted to be in contact with and slideable over but not affixed to guide means 32 and 54. There are a plurality of spaced apart forked receivers 38 having U-shaped arms 39 (forming a slot therein between) attached to chain 51 and adapted to be threaded into slots 30 of form carrier means 29. Dogs 41 (affixed to chain 40) are spaced from each other so that they perform the functions of stripping, transporting and inserting as above described. Chain 40 is a continuous chain and travels in the direction shown by arrow 18 at a predetermined speed. Dogs 40 disengage themselves from tube 28 at the chain path terminal point (where chain 40 changes direction) after form carrier 29 has been threaded onto forked receiver 38.

Figure 4:
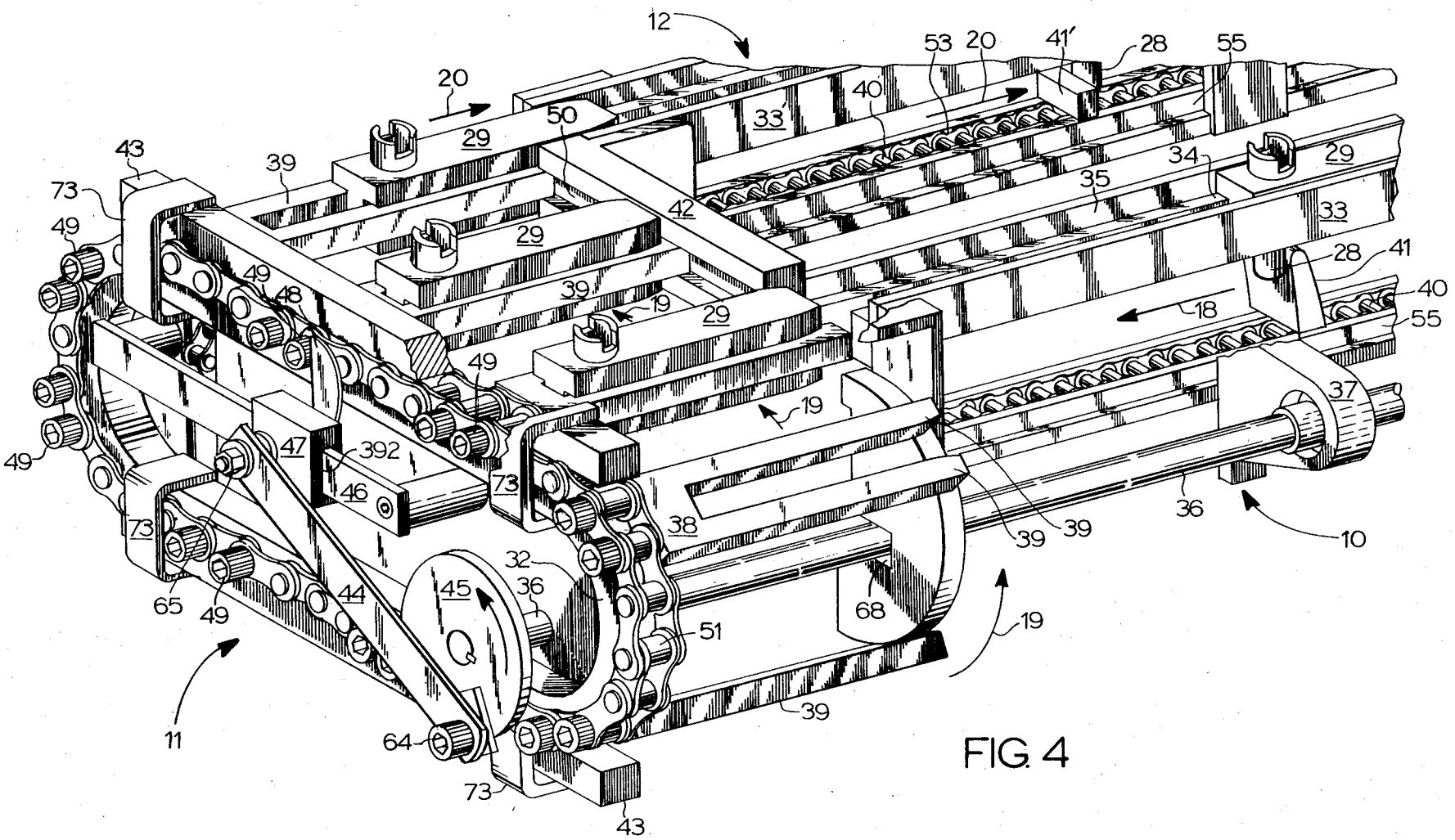
FIG. 4 is a perspective fragmentary view of the second, third and fourth tracks of FIG. 1.

Form carrier 29 along with the sock boarding form 6 and rod 7 are transported by track 11 in a direction essentially perpendicular to the longitudinal axis of tracks 10 and 11 until forked receiver 38 (with form carrier 29 threaded thereon) reaches the position shown in the extreme upper left-hand corner of FIG. 4, i.e., it is aligned with track 12, e.g., aligned with channel 33'. When this happens, form carrier 29 is stripped from forked receiver 38 by dogs 41' of chain 40' and threaded over laterally extending protrusions 34 of channel 33'. Dogs 41' carry form carrier 29 via channel 33' to sock loading position "X" of FIG. 1 then through slit 4' and thereafter (because of the location of the terminal portion of chain 40') cause form carrier 29 to be removed (stripped) from channel 33' and its protrusions and inserted into receiver 8 to begin its course of travel all over again.

Track 11 contains an indexing apparatus composed of disk 45 attached in an off-center manner by means of nut and bolt 64 to elongated push rod 44. A terminal portion of push rod 44 is attached by means of nut and bolt arrangement 65 to block 47, which has an aperture 392 therein. Slide bar 46, attached to and spaced apart from guide means 32, is threaded into aperture 67. This combination of elements converts the rotational motion otherwise exerted by disc 45 and push rod 44 into a linear reciprocating motion. Block 47 has disposed thereon upstanding dog member 48 adapted to come into an engagement with lateral protrusions 49 of chain 51. Dog member 48 is curved on one free edge. It is rotatable in the direction of directional arrow 19 but non rotatable in the opposite direction (counterclockwise) when the opposite (non curved) edge comes in contact with element 49. Once the straight edge of dog 48 is engaged with protrusion 49, on rotation of disc 45 by axel 36 the combination of elements 38, 44, 45, 46, 47, 48, 64 and 65, cause chain 51 and forked receiver 38 to be periodically advanced a predetermined distance along the longitudinal axis of directional arrow 19. All of the aforementioned elements in the preceeding sentence are referred to collectively as an actuator.

Figure 9:
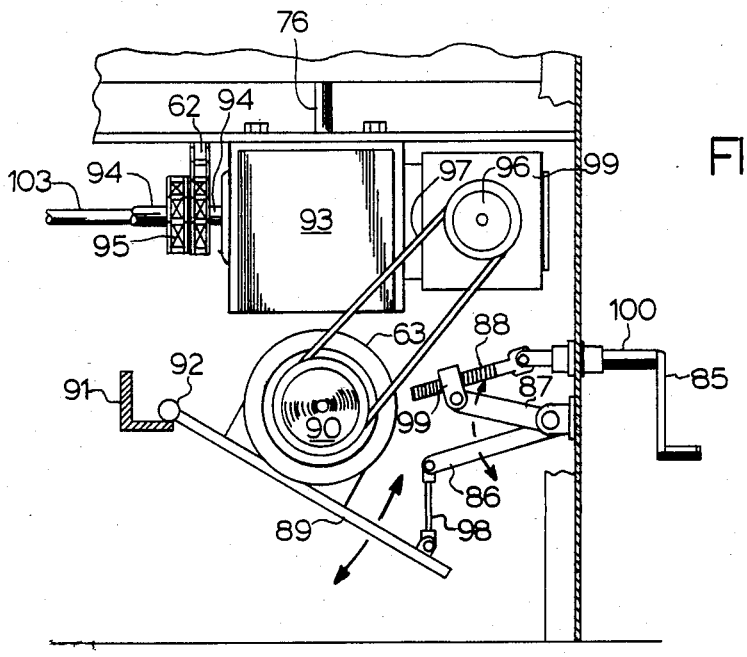
FIG. 9 is a partial schematic representation of a power and drive train apparatus for first, second, third and fourth tracks and sock remover of FIG. 1.

Axle 36 is affixed to and causes disk 45 to rotate. This action causes chain 51 to rotate (periodically advanced in the manner as shown by directional arrows 19) resulting in forked receiver 38 (with form carrier 29 threaded therein) to be advanced in the same direction. Disc 45 is affixed to axle 36, which is journaled into guide means. Axle 36 is disposed in aperture 68 in guide means 54 and further journaled in bearing 37. Axle 36, through gear means 69, 54, 55, 56 and 57 (see FIG. 5) is in mechanical engagement with axle 58, which is in mechanical and rotational engagement with chain 62 (FIG. 5), driven by motor 63 (FIG. 9). Axle 58, through gear means 60 and 61 and axle 59 (FIG. 7) are attached (not shown) to chain 40. Axle 58 is attached to sprockett 71' and drives chain 41. See FIG. 6. The aforementioned gears and dogs are so structured and designed that an orderly spaced apart procession of form carrying means 29 proceeds in the manner previously described.

Figure 5:
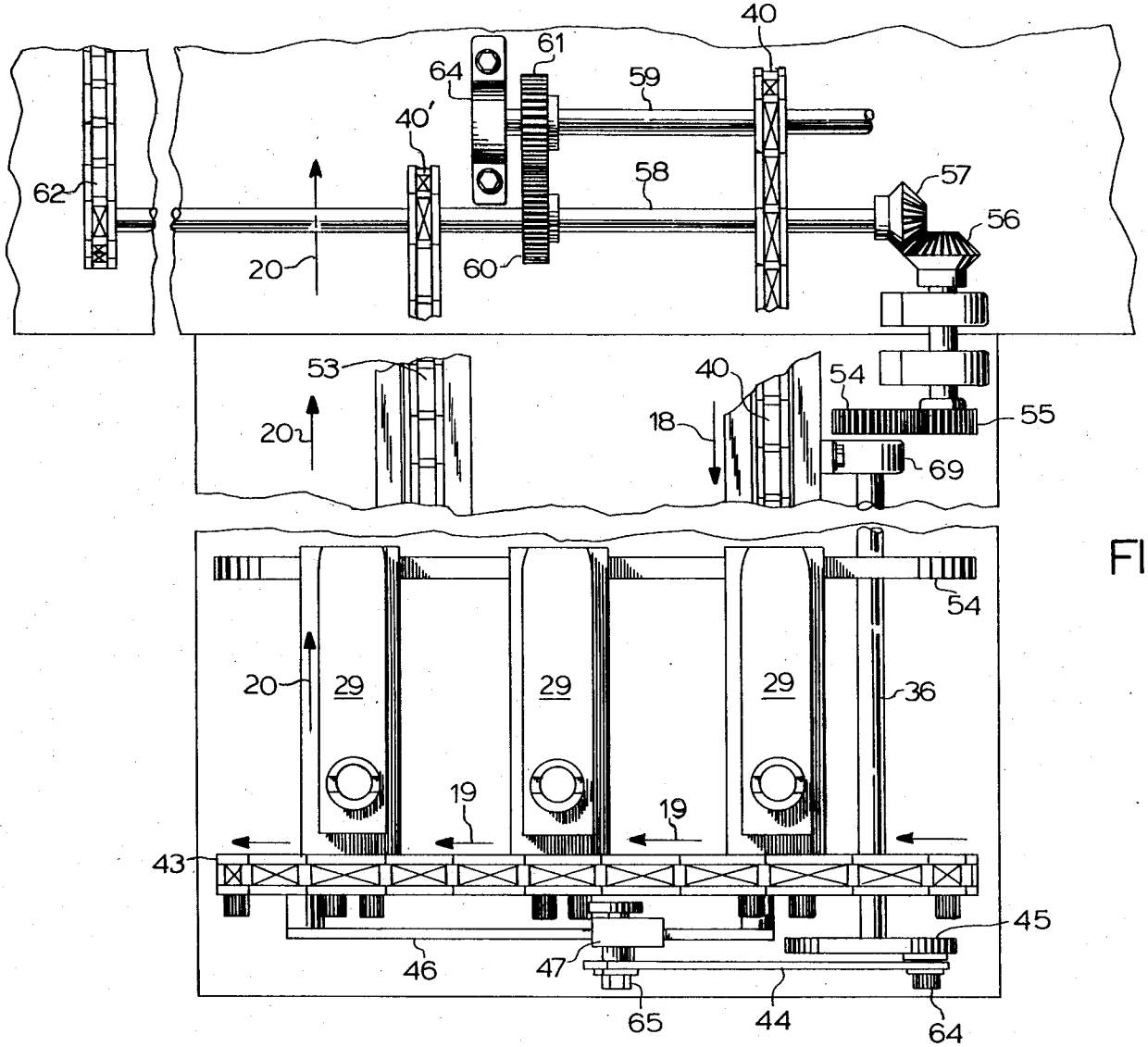
FIG. 5 is a perspective fragmentary view of timing and controlling mechanisms for simultaneously driving and controlling the speed of travel of the first, second, third and fourth tracks.

FIGS. 5 and 9 shows some of the details of the driving mechanism of the invention. Element 63 is a motor having a prior art variable speed pulley mechanism composed of drive pulley 96, belt 97, drive pulley 90, platform 89, hinge 92, bracket 91, linkage arm members 98, 86, 87, and 99, and adjusting means 88, 100 and 85. Motor 63 is affixed to platform 89 which is hingeably attached to bracket 91 by hinge 92. This variable speed mechanism operates in a prior art manner, namely: (a) tightening of belt 97 by rotating crank 85 and shaft 100 causes threaded shaft 88 to drive linkage 99, 87, 86 and 98 so as to move platform 89 in a downward direction causing the sidewalls of pulley 90 to "spread" thereby causing the belt 97 to drive pulley 96 and gears in gear box 99 at a slower speed; and, (b) loosening tension of belt 97 by reverse cranking of element 85 in like manner causes the sidewalls of pulley 90 to narrow causing belt 97 to run faster thereby driving gears in gear boxes 93 and 99 faster.

Figure 2:
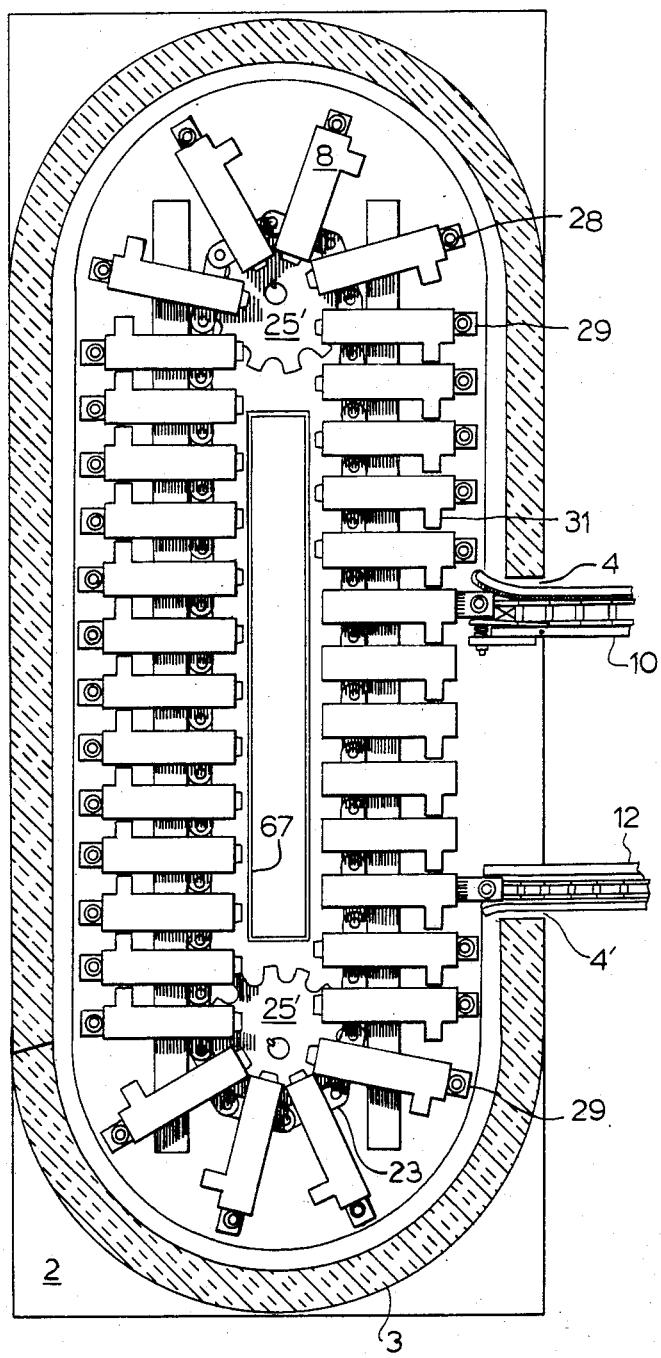
FIG. 2 is a plan view of the first track of FIG. 1.

Connected to gear boxes 93 and 99 are two axles 76 and 94. Axle 103 is behind axle 94, only a portion of it being shown in FIG. 9. Chain 62 (see FIG. 11) threaded over sprocket 105 affixed to axle 58 (see FIG. 5), and drives tracks 10, 11 and 12. Chain 95 threaded over sprocket 104, drives grasping means 113, belt pulley 14 and tray 15. Axle 76 drives sprocket 25 (located in heating chamber 2) which in turn drives continuous chain 23 (FIG. 2). Axle 58 through pinion gears 60 and 61 drive axle 59 which in turn drives sprockets 71 and 74. See FIGS. 6 and 7.

Figure 6:
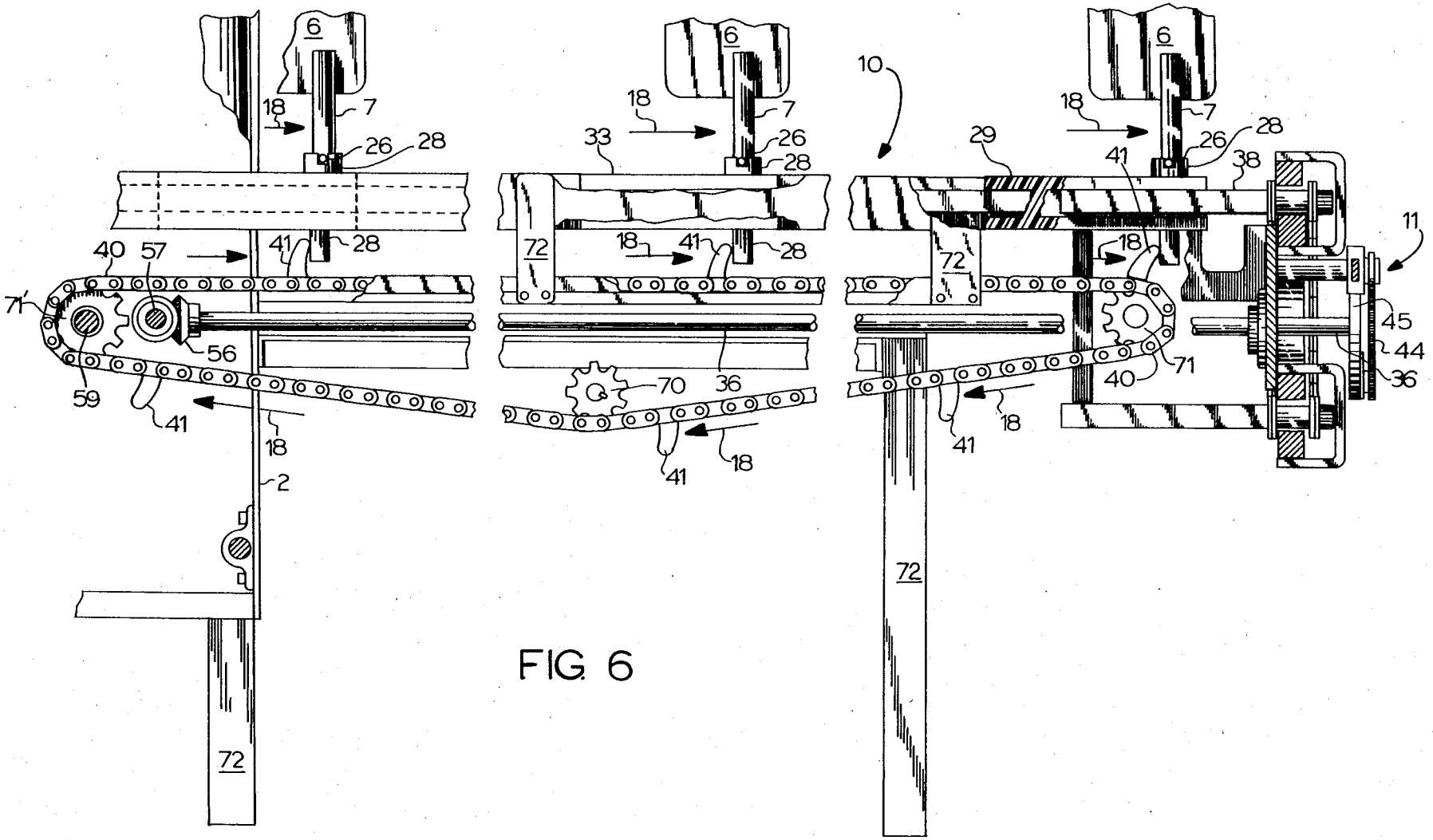
FIG. 6 is a partial side elevation of track 10 of FIG. 1.

FIG. 6 is a partial side elevation of track means 10. Upright members 72 form a base to which channel 33 is affixed. Chain 40 (along with dogs 41) is threaded over sprockets 71'—71. sprocket 71' is driven by axle 59. Sprocket 70 is a tensioning-idler sprocket whereas sprocket 71 is an idler sprocket. Directional arrows 18 indicate the direction of travel of chain 40, the direction being from the heating chamber 2 towards and to track 11 and forked receiver 38. Along this direction of travel, dogs 41 engage the lower portion of tube 28 and thereby convey form carrier means 29 along channel 33.

Figure 7:
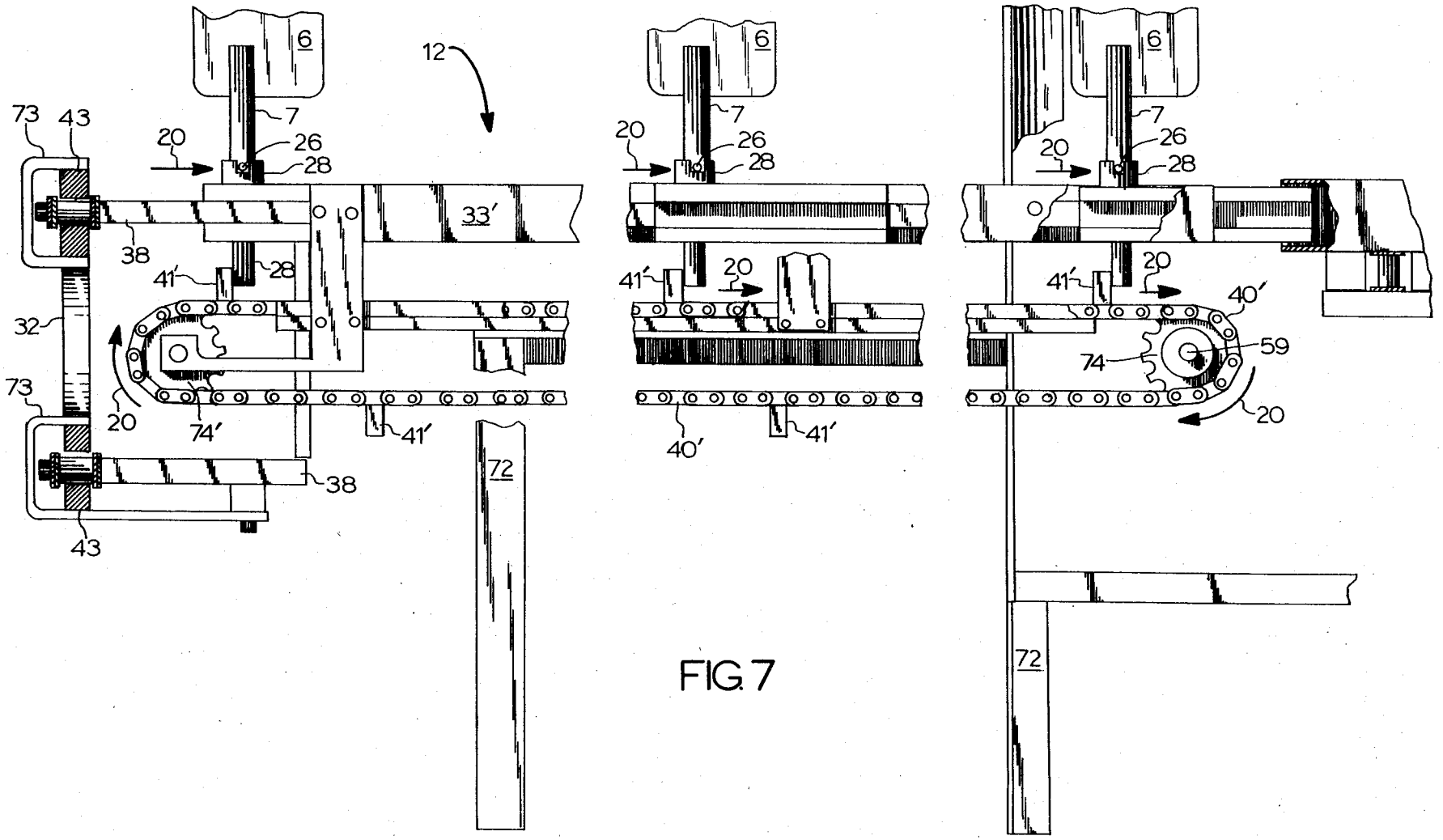
FIG. 7 is a partial side elevation of track 12 of FIG. 1.

Referring to FIG. 7 (track 12), element 72 forms a base upon which channel 33' is disposed, composed of like elements similar to channel 33. Chain 40' is threaded over sprockets 74 and 74', sprocket 74 being driven by axle 59. Sprocket 74' is an idler sprocket. Direction arrows 20 point in the direction of travel of chain 40' and dogs 41' affixed thereon, namely from track 11 to the heating chamber 2. By such action, dogs 41' engage the lower portion of tube 28, strip form carrier 29 from forked receiver 38 (while it is in track 11), thread element 29 onto protrusions 34 of channel 33' (as more fully shown by FIG. 4) and transport form carrier means 29 along channel 33' through slit 4' to the heating chamber 2. Just inside heating chamber 2, dogs 41' strip form carrier 29 from channel 33' and insert it into receiver 8. The stripping and inserting action by dogs 41' is accomplished by reversing the travel path of chain 40' at appropriate point (location of sprockets 74'—74) relative to forked receiver 38 and receiver 8 respectively. The same kind of stripping and inserting action is accomplished by the apparatus shown in FIG. 6 where dogs 41 strip form carrier 29 from receiving means 8 and threading element 29 onto the lateral protrusions 34 of channel 33, transport it through slit 4, along channel 33 and insert it in between the laterally extending and spaced apart arms 39 of forked carrier 38. Such stripping and inserting is accomplished by reversing the travel path of chain 40 at the locations where sprockets 74 and 74' are located so that after the stripping of element 29 from element 8 is accomplished, dog 41 remains in contact with tube 28 to convey element 29 along the longitudinal path of element 33 and after stripping element 29 from element 33 and inserting it into element 38, at which point dog 41 (by action of travel point termination of chain 40) disengages itself from element 28. A like but reverse action takes place with dogs 41', chain 40' and sprockets 74 and 74'. Sprocket 74' is so positioned that dog 41' engages tube 28, strips element 29 from element 38, threads it onto element 33', conveys it along element 33', strips it from element 33' and inserts it into element 8 at the location of sprocket 74 where the travel point of chain 40' is reversed.

The diameter of disk 45, the length of push rod 44 and slide bar 46 are obviously designed in conjunction with the the rotational speed of axles 36 (gears 54, 55, 56, 57 and axle 58), so that dog 48 advances chain 51 and forked receiver 38 in a timed sequentially linear manner so that element 38 is aligned with channel 33 at the same instant that dog 41 begins its reverse (reverse from directional arrow 18) travel path at the terminals of channel 33. This co-action strips element 29 from element 33. Additionally, such a combination requires that element 38 be aligned with channel 33' at the instant dog 41' begins its travel path (element 20) towards heating chamber 2.

The method of drying and setting of socks using heating chamber 2 and the various tracks (heating chamber track, elements 10, 11 and 12) as described above is as follows: An operator is stationed at "Loading" Position "X." As forms 6 pass by, socks 9 are threaded over a terminal portion of form 6. Thereafter form 6 is traversed to heating chamber 2 via slit 4' where the socks are dried and "set." Form 6 with sock 9, dried and set, emerges from heating chamber 2 via slit 4 and passes through "Take Off" position "Y." More particularly, form 6 passes in between stabilizer arms 68 and simultaneously therewith a take off and stacking device (a remover), more fully described herein, removes sock 9 and stacks it. Naked sock boarding form 6 then proceeds along track 10, to track 11 and thence along track 11 to track 12 (as previously described) to Loading Position "X".

After form carrier 29 and sock boarding form 6 have traversed a predetermined path in heating chamber 2, element 29 is stripped from element 8 and threaded onto track 10. The combination of elements 29 and 6 pass through station "Y" a sock removing station on track 10. At this station, elements 6 and 7 pass through guide means 24 (see FIG. 1) during which sock 9 is automatically removed from element 6 in a manner hereinafter described.

Guide 24 is affixed to track 10 and is composed of two pairs of spaced apart, biased, horizontally disposed arms 68 and 68'. Each pair of arms (upper and lower pair) is spaced apart from the other by upstanding members 69 and the members of each pair of the upper pair (elements 68) are biased toward each other, i.e., pair arm members 68 are biased towards each other by spring 75. The uppermost surface of tube 28 fits under pair members 68'. Such an arrangement keeps rod 7 from being pulled out of tube 28 when sock 9 is being removed from element 6. Pair members 68' and flaccid article boarding form 6 enter upper pair members 68 as elements 6 and 7 travel over track 10 in the direction shown by the directional arrows of FIGS. 1 and 8. Both pair members 68—68 and 69' and 69' are flared (see FIG. 8) so as to present a converging and opposing pair of sidewalls to the respective elements 6 and 7 as they enter, traverse, and leave pair arms 68—68 and 68'—68' of elements 24. The purpose of guide 24 is to accurately position element 6 and brace same so that it will accurately align itself with and be stable during the removal of sock 9 by a remover yet to be described.

Figure 10:
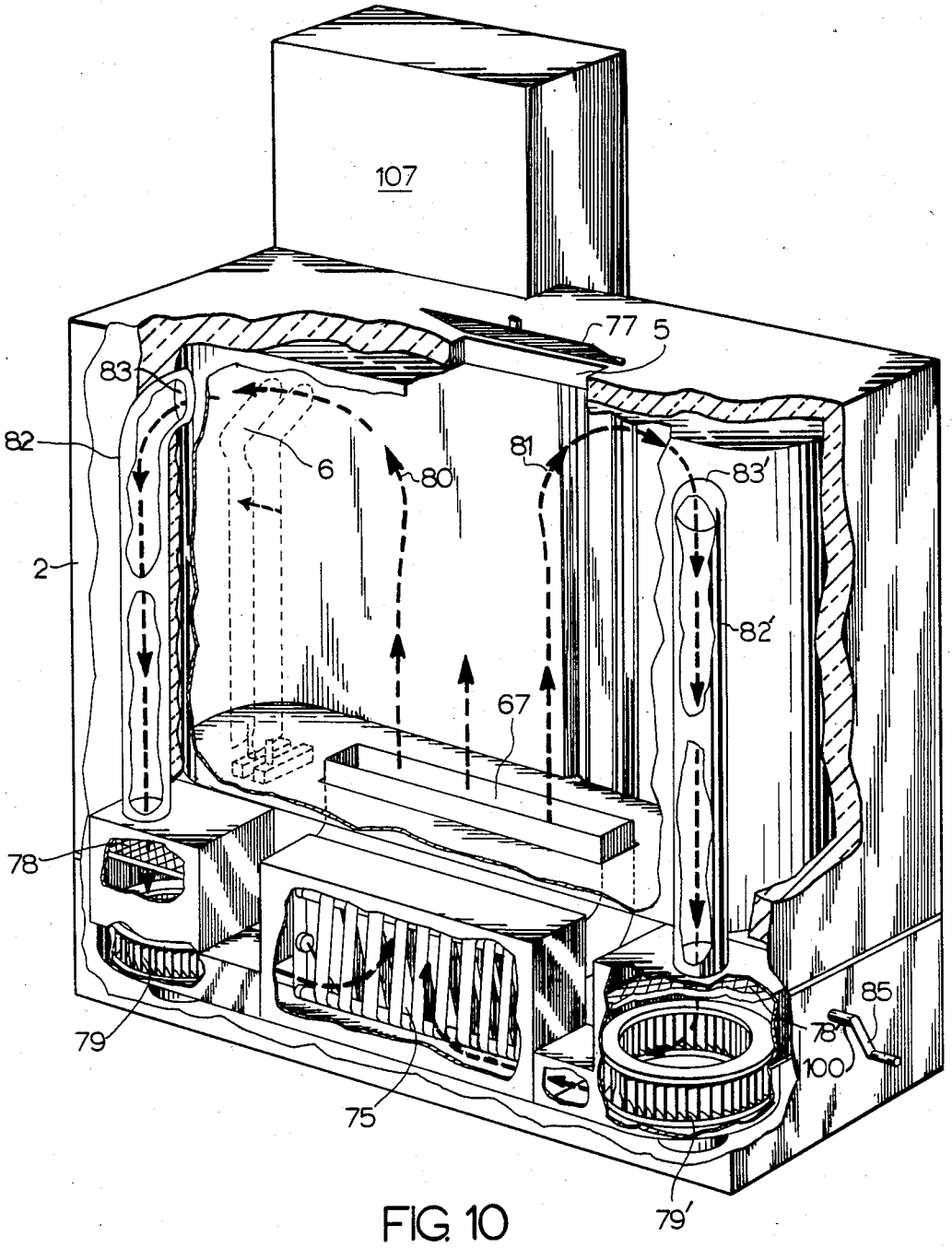
FIG. 10 is a cut-a-way perspective view of heating chamber 2 of FIG. 1.

In FIG. 10, details of the heating chamber 2 and how it heats air circulating in its interior are shown. Heater 75 is disposed in the lower portion of heating chamber 2 and receives air through ducts 82 and 82' via filters 78—78'. Air is removed by turbine fans 79—79'. Air movement arrows 80 and 81 indicate air movement to left and right ducts 82—82' respectively. Initially, air from outside of chamber 2 is drawn through slits 4—4' and thereafter it flows along directional arrows 80–81. Element 5 is a moisture vent (hole in the roof of chamber 2) covered by a manually, or automatically operated flap 77, movable to various positions as the ambient and chamber relative humidity air dictates to permit escape of moisture laden air as desired. Turbine fans 79—79' force the chamber air over heater 75 and into the interior of chamber 2 over socks 6. Afterwards, some of the heated air is recycled by being forced into return openings 83—83' through return ducts 82—82' through air filters 78—78' and back over heater 75, through duct 67, thence into the interior of chamber 2.

Figure 11:
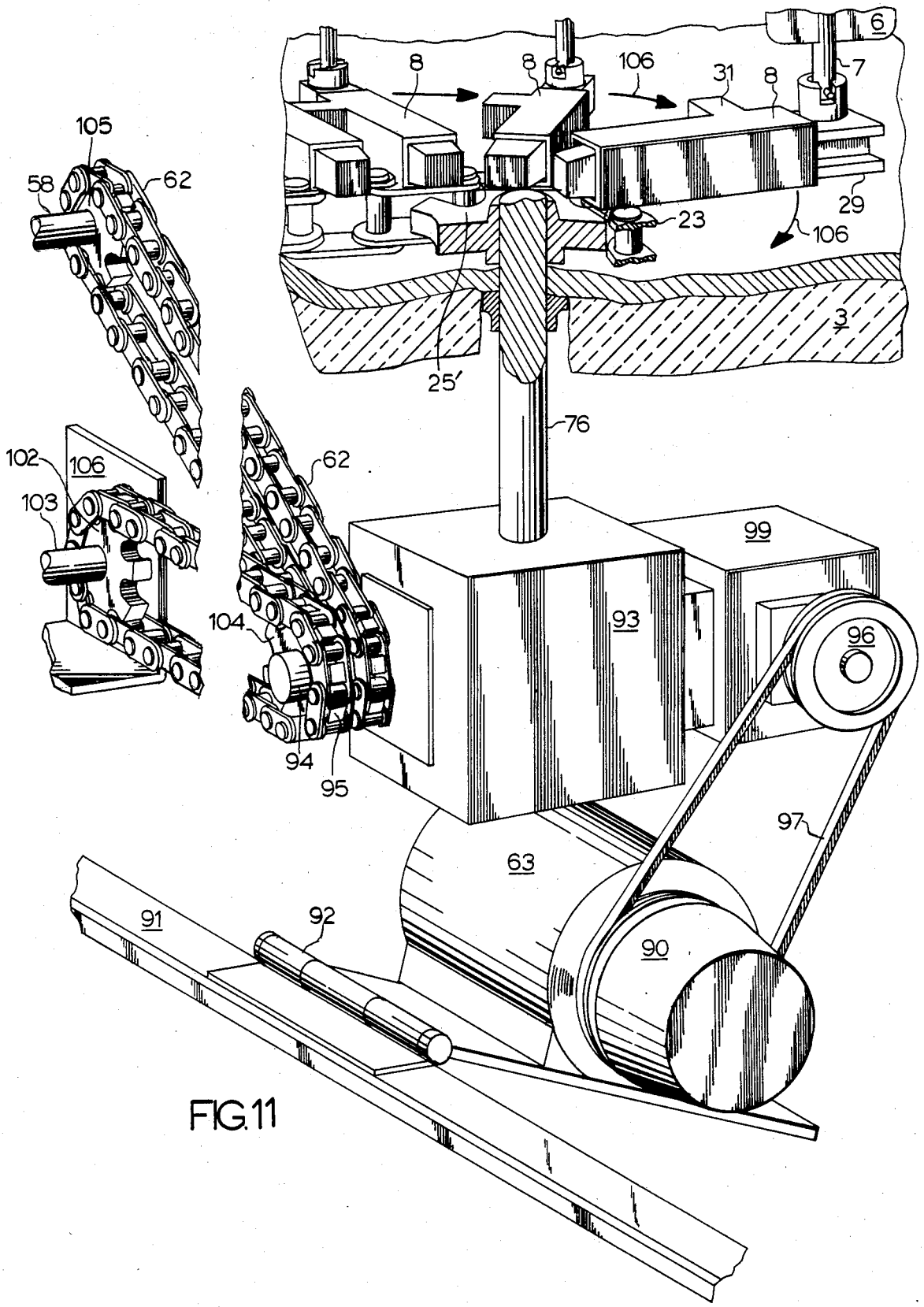
FIG. 11 is a partial cutaway perspective view of the motor-gear box arrangement used to drive the first, second, third and fourth tracks and sock remover of FIG. 1.

Referring to FIG. 11, apparatus is shown that drives the first track and other mechanisms. Element 63 is a motor having variable speed drive 90 (see FIG. 9) which through belt 97 drives pulley 96 gear boxes 99 and 93, which in turn drives shaft 94. Two sprockets are mounted on shaft 94, sprockets 104 and a sprocket (not numbered) to the right of element 104, the latter sprocket driving chain 62 (see also FIG. 5) which in turn drives sprocket 105 (attached to axle 58) which drives axle 58 which drives axle 36 (through gears 57 and 56) and thus tracks 10, 11 and 12. Shaft 76 drives sprocket 25' thus driving chain 23. Referring to FIG. 5, axle 58 drives axle 59 via gears 61 and sprockets thereon that drive chain 40 and 40'. Axle 59 is journaled at one end in element 64. Sprocket 102 is driven by sprocket 104 via chain 95. Sprocket 102 drives axle 103. Axle 103 drives all of the apparatus used to remove a sock 9 from form 6, convey it to belt 13, tray 15 and flat receiving means 16.

Figure 12:
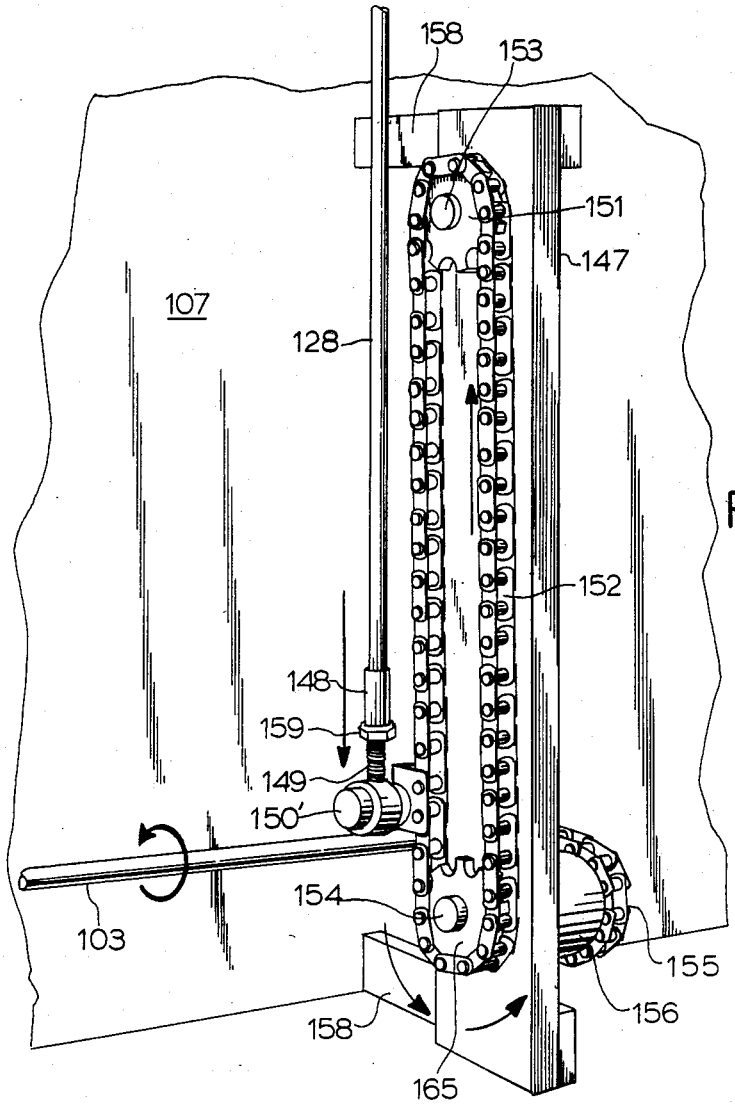
FIGS. 12 and 13 are partial perspective views of power drives and directional apparatus for the sock remover of FIG. 1.
Figure 13:
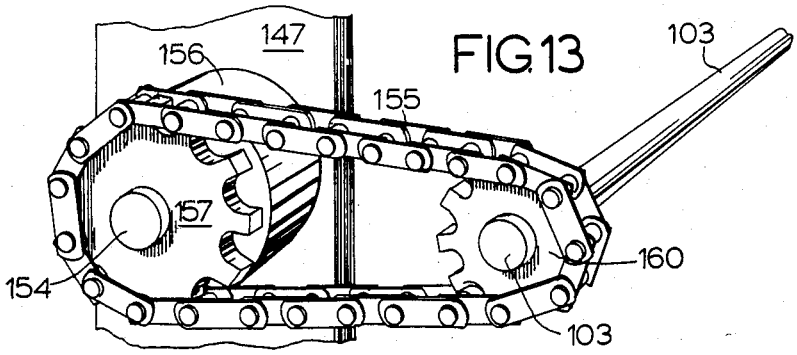
Figure 14:
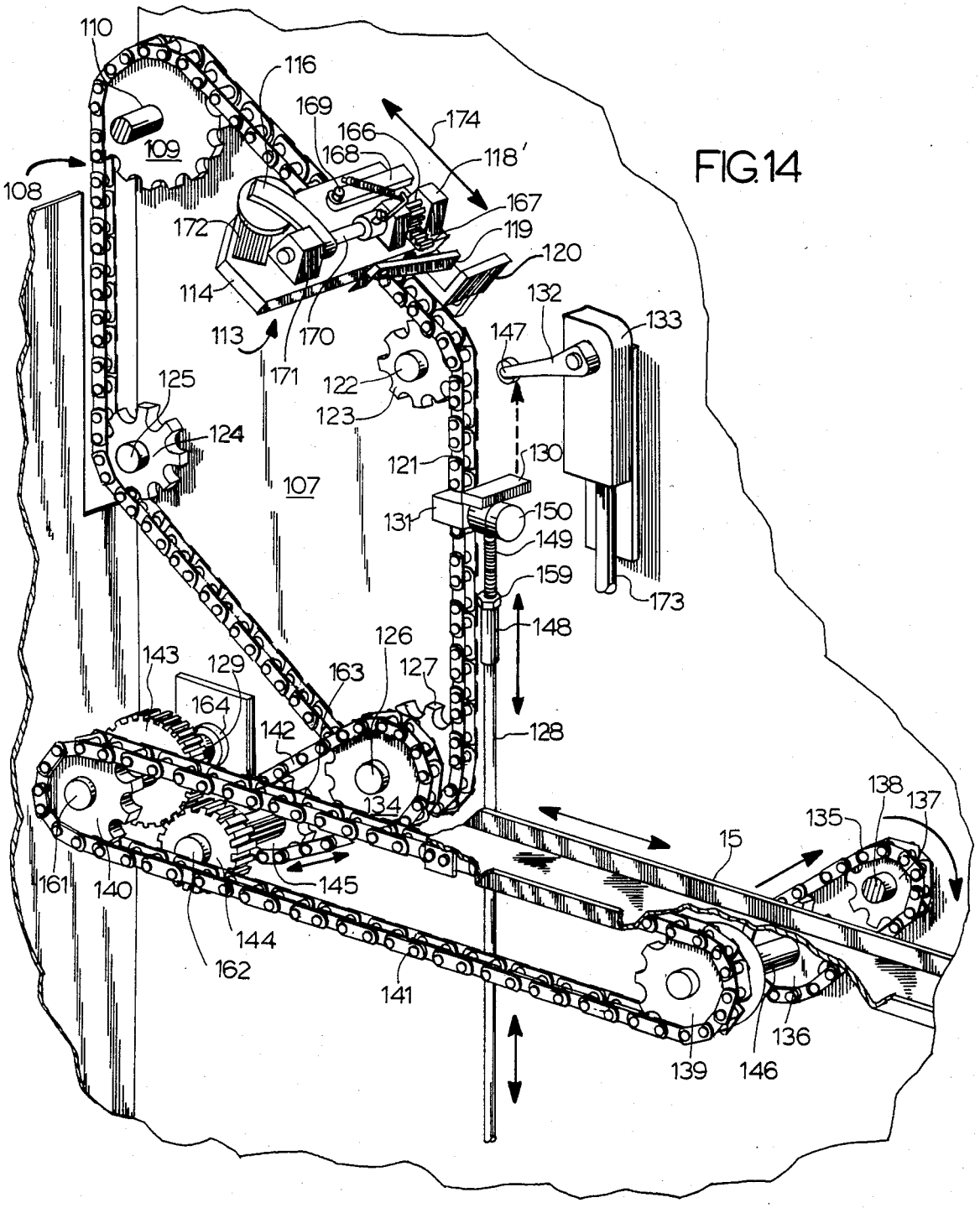
FIG. 14 is a partial perspective view of the power and directional apparatus for the sock remover.

FIGS. 12, 13 and 14 describe the basic method and apparatus of the invention for grasping a sock 9 while it is threaded on sock boarding form 6 at position "Y", striping it from element 6, depositing sock 9 on belt 13 and depositing sock 6 on tray 15. The apparatus of FIGS. 12 and 13 are the basic driving apparatus for the apparatus of FIG. 14. Axle 103 drives sprocket 160, which drives continuous chain 155, which drives sprocket 157 affixed to axle 154 journaled in gear box 156 supported on support 147. Axle 154 drives sprocket 165 which drives continuous chain 152 threaded over idler sprocket 151 affixed to axle 153. Attached to continuous chain 152 is tie-rod end member 150' attached to adjustable means 148 and 149 and made secure thereto by nut means 159. Adjustable means 148 and 149 forms a terminal portion of tie-rod 128. Sprockets 165 and 151 are affixed to axles 154 and 153 respectively, both axles being journaled in support 147, affixed to wall 107 by member 158.

Figure 17:
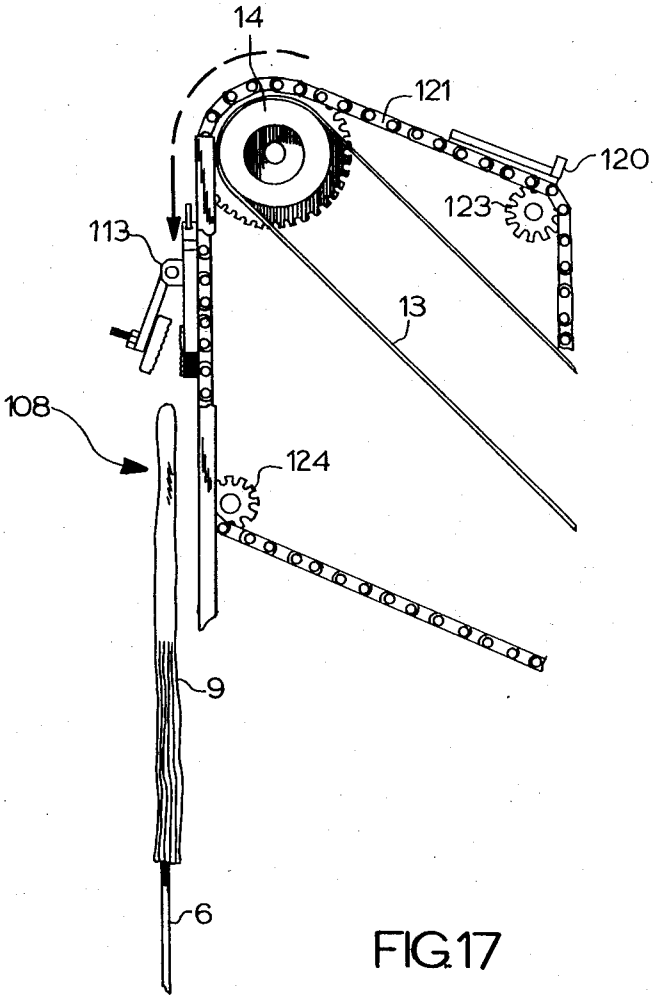

The other terminal end of tie-rod 128 has like adjustable means 148 and 149, tie rod end member 150 and nut means 159. Attached to element 150 is paw 131 and paw arm 130. Paw 131 is affixed to continuous chain 121 and adapted to come in contact with contact means 147 attached to pivotable arm 132 of limit switch 133. Paw arm 130 and paw 131 are affixed to chain 121 at such a position so that when the lowermost tie-rod end member 150' (FIG. 12) reaches the uppermost limit of chain 152 on its upward leg of travel, paw arm 130 strikes element 147, pivots arm 132 and activates (closes) normally open limit switch 133. At this point, i.e., when limit switch 133 is turned on, grasper 113 (also affixed to chain 121) is in a position indicated generally by element 108. See FIG. 17.

Chain 121 is a continuous chain, threaded over sprockets 109 (affixed to axle 110), 124 (affixed to axle 125), 127 (affixed to axle 126) and 123 (affixed to axle 122). See FIG. 14. Power to drive chain 121 is derived by the "up" and "down" (reciprocating) action of tie rod 128 (affixed to chains 152 and 128 by elements 150' and 150 respectively) as element 150' travels around the oblong path of chain 152 (see FIG. 12). Thus chain 121 goes first in an upward direction to the upper left of FIG. 14 (as indicated by the left-hand portion of movement arrow 174) to a first position at which time sock 9 is removed from element 6 and then reversing its travel to go to a second position, generally delimited by stop means 120, at which time the sock 9 in the grasp of grasping paw 116 and pad 172 is released onto belt 3 in a hereinafter described manner.

Figure 15:
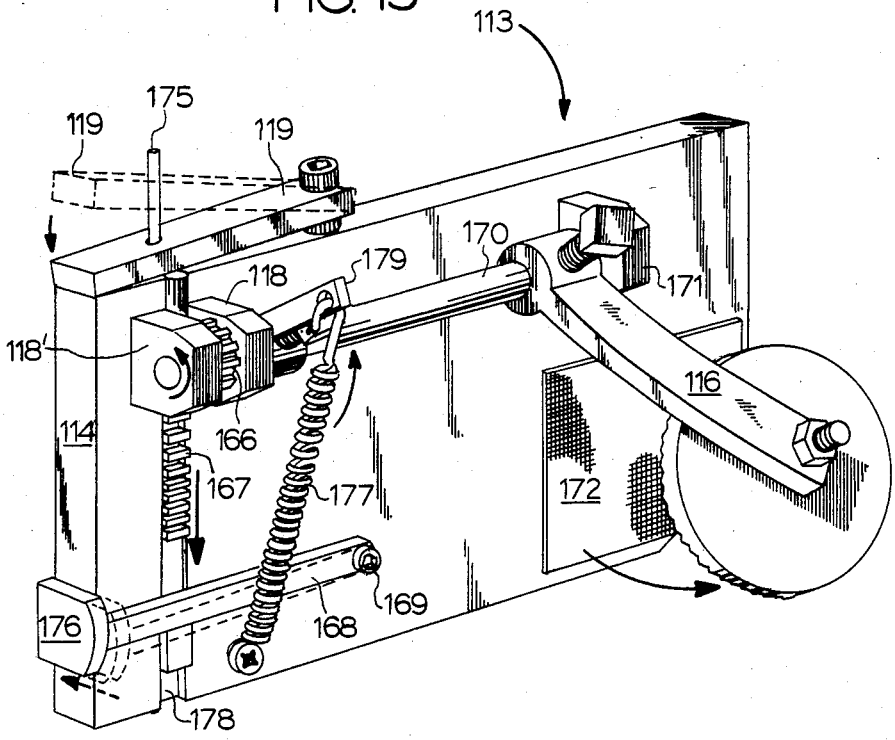
FIGS. 15 and 16 are partial perspective detail views of the grasper of FIG. 14.
Figure 16:
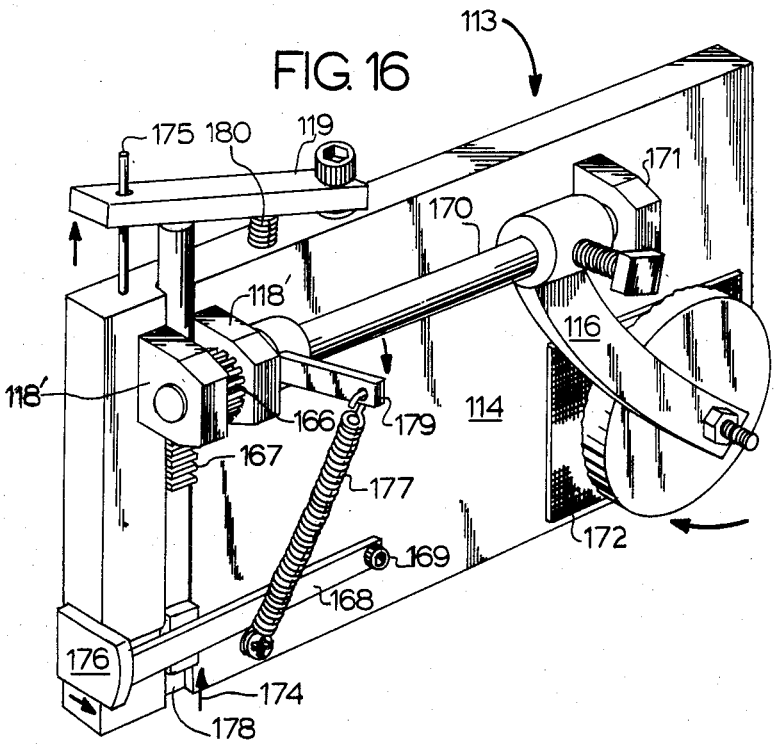
Figure 18:
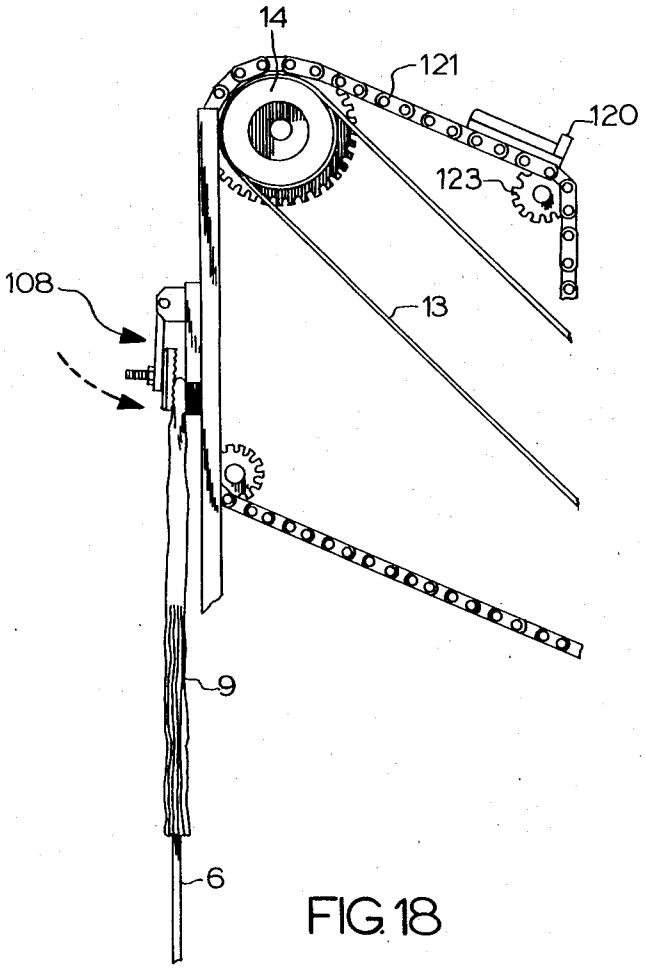
FIGS. 17, 18, 19 and 20 are schematic partial views of the initial portion of the sock remover of FIG. 1.

Grasper 113 (see FIGS. 14, 15 and 16) is composed of base 114, pad 172, grasping paw 116 and shaft 170 journaled in pillow bearings 171 and 118. Pinion gear 166 is journaled in bearings 118 and 118'. Rack gear 167 is slideably received in slot 178 in base 114 and adapted to travel (in the same general direction of travel arrow 174) between two positions, one delimited by latching means 168 and another by engaging means 119. Latching means 168 is spring biased and thus adapted to engage rack gear 167 in a well known manner and hold it in a given position. See FIG. 16. Movement of rack gear 167 rotates pinion gear 166 and shaft 170 and thus rotates grasping paw 116 from an open (grasping paw 116 spaced apart from pad 172) to a closed (grasping paw 116 pressing against pad 172) position, see FIGS. 15 and 16 respectively. A spring (see element 177 of FIGS. 15 and 16) biases grasping paw 116, to a normally closed position, i.e. grasping paw 116 pressing against pad 172.

By moving rack gear 167 in the upward left direction of directional arrow 174 rack gear 167 rotates pinion gear 166 and shaft 170 to an open position. At this time latch means 168 (biased towards the teeth of rack gear 167) engages the teeth of rack gear 167 and holds it in such a position, resulting in grasping paw 116 and pad 172 being in a spaced apart ("open") position. Such action takes place at stop means 120. When grasper 113 is transported towards stop 120, it engages engaging arm 119 and pushes rack gear 167 into the "open" position. This is happening, when tie rod member 150' is in its lower most position of travel, i.e. rounding sprocket 165. On its upward travel path, tie rod 128 causes chain 121 to transport grasper 113 to a position indicated generally by element 108, directly poised over and aligned with the terminal portion of sock boarding form 6 while element 6 is at position "Y". At that instance, paw arm 130 strikes contact 147, rotates arm 132 thereby closing normally open switch 133 to create an electrical circuit via insulated electrical conductors 173 to a solenoid (not shown) which activates arm 176. Arm 176 in turn lifts up moving latch 168 about pivot point 169. By so doing, spring 177 causes shaft 170 to rotate (see FIG. 16) causing grasping paw 116 to press down on anything (a sock 9 for example) between it and pad 172. After this action, rod 128 begins its downward movement (the rod end member 150' at this instance having reached the highest point of its upward travel) thus causing chain 128 to reverse its direction and thereby transporting grasper 113 from that position indicated by element 108 (first position) to a second position (engaging means 119 engaging with stop means 120) where the grasper is once again rendered to its normally open position by the action of rack gear 167 rotating pinion gear 166, shaft 170 and grasping paw 116, thereby allowing sock 6 to fall onto conveyor belt 13.

Continuous chain 121 (FIG. 14) drives sprocket 127 which, through axle 126, drives sprocket 134. Continuous chain 142 is threaded over sprockets 134 and 145. Sprocket 145 affixed to axle 162 drives gear 144 Gear 144 drives gear 143 which is affixed to axle 161 which in turn is journaled in bearing 164. Axle 161 drives sprocket 140. Continous chain 141 is threaded over sprockets 140 and 139 and through axle 146, sprocket 136 is driven. Continous chain 135 is threaded over sprockets 136 and 137. Sprocket 137 is affixed to axle 138, which is connected to a one way rotational gear box (not shown). Sprocket 137 may rotate only in a clockwise manner. All other sprockets shown in FIG. 14 do not have such a limitation, i.e., they may rotate in either direction, clockwise or counterclockwise.

Figure 20:
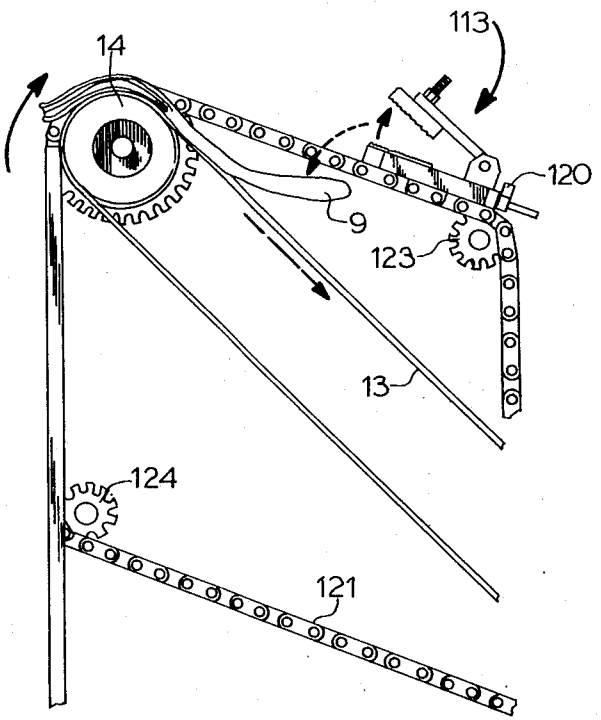
Figure 19:
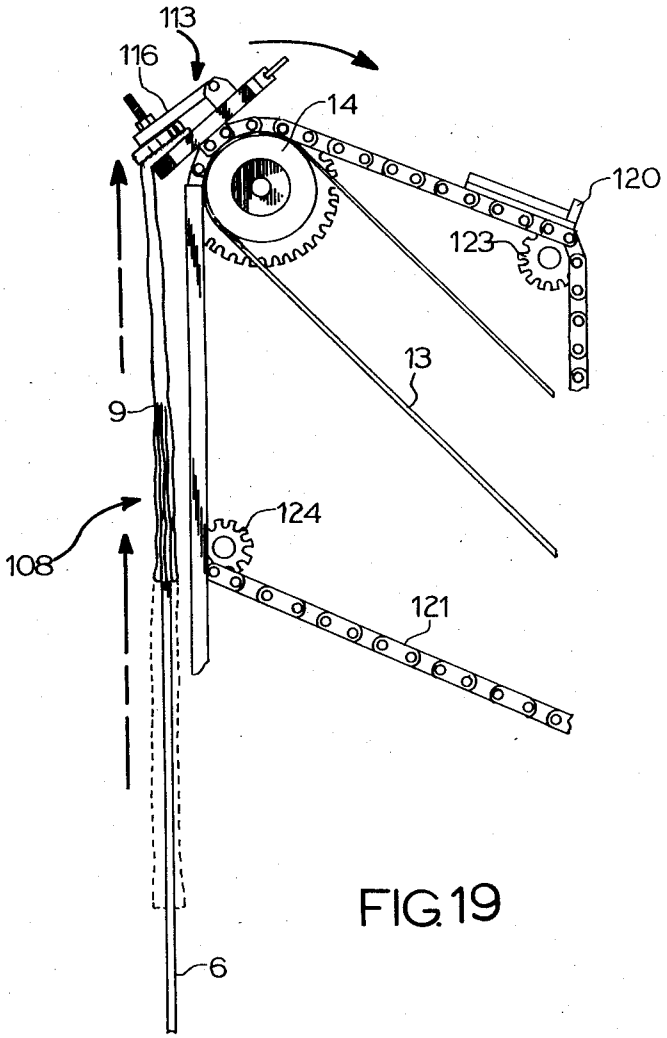

Pulley 14' (see FIG. 22) is affixed to axle 138 and pulley 14 is affixed to axle 110. Continuous belt 13 is threaded over pulleys 14—14'. Socks 9 are deposited on belt 13 by grasping means 113 in the manner just described. See FIGS. 20 and 21.

Reference is now made to FIGS. 17, 18, 19, 20, 21 and 22. In the sequence shown in these figures, sock 9 is grasped at the position indicated by element 108, transferred over sprocket 109 (see FIG. 14) to stop 120 (FIGS. 19 and 20) then released onto belt 13. See FIG. 20. There may be two socks 9 simultaneously in contact with belt 13, however, one sock 9 at a time is deposited in tray 15 (see FIG. 21). Tray 15 is attached to continuous chain 141 and because of the first one direction of travel and then another and reverse direction of travel arising out of the reciprocating travel of rod 128, chain 141 travels first in a direction to the right and then a direction to the left in synchronous harmony with paw 130 striking contact 147, so that belt 13 deposits one sock 9 at a time on tray 15. That is, an upward stroke or travel of tie rod 128 causes chain 121 to rotate counterclockwise causing chain 141, through chain 142, to rotate counterclockwise thus moving tray 15 to the extreme left (a first position). A clockwise rotation of chain 121 (a downward movement of tie rod 128) causes clockwise rotations of chains 142 and 141, thus causing tray 15 to move in a second position, to the extreme right. See FIG. 21. At the first position (FIG. 21), a terminal portion of sock 9 from belt 13 is deposited on tray 15 (not shown). Subsequently, tray 15 is moved to the right and sock 9 is thus longitudinally "laid out" in tray 15 by such relative motion. It is stripped from tray 15 and deposited on flat receiver 16 by means of holder 17.

Figure 21:
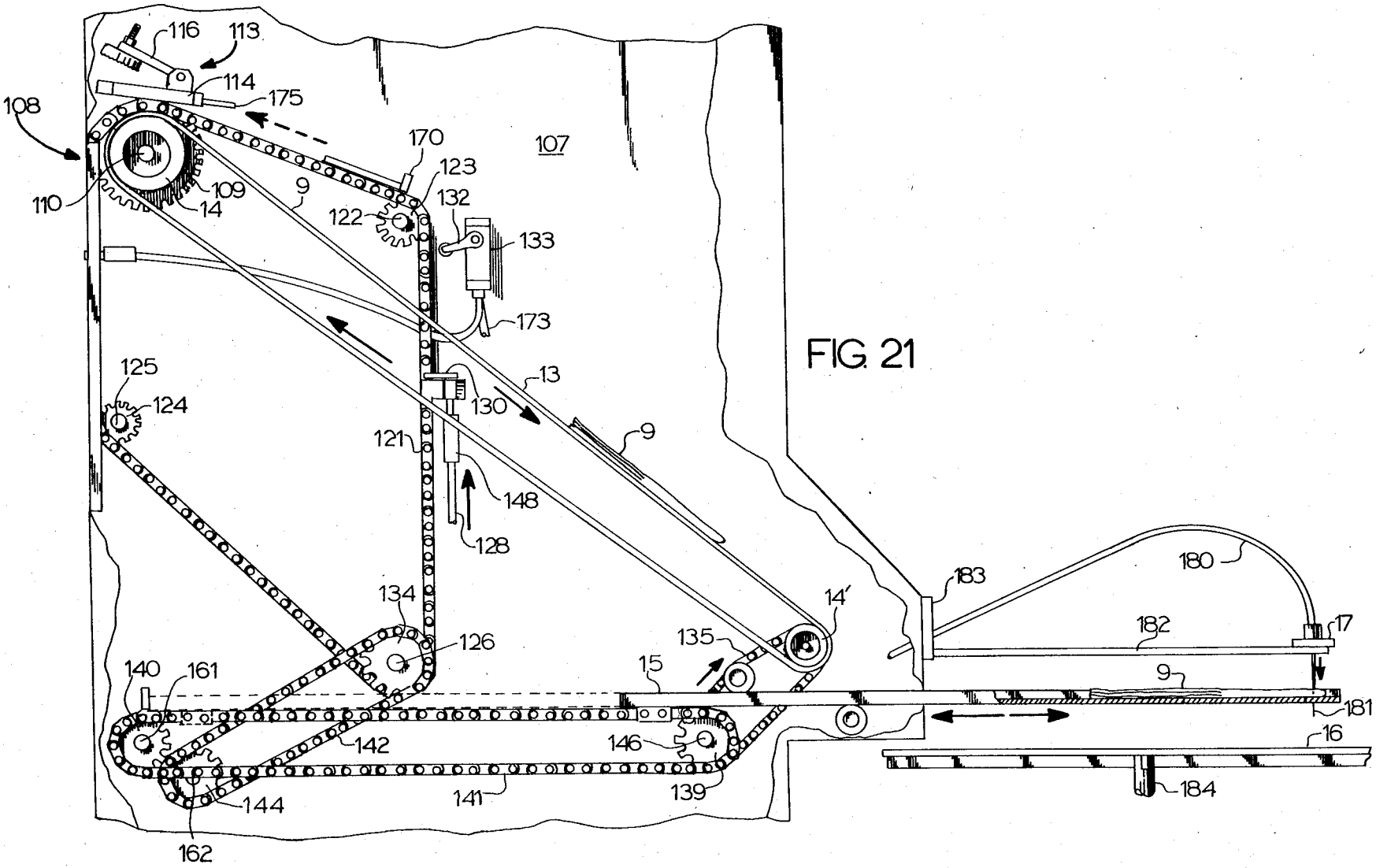
FIGS. 21 and 22 are schematic partial views of the terminal portion of the sock remover of FIGS. 17, 18, 19 and 20.
Figure 22:
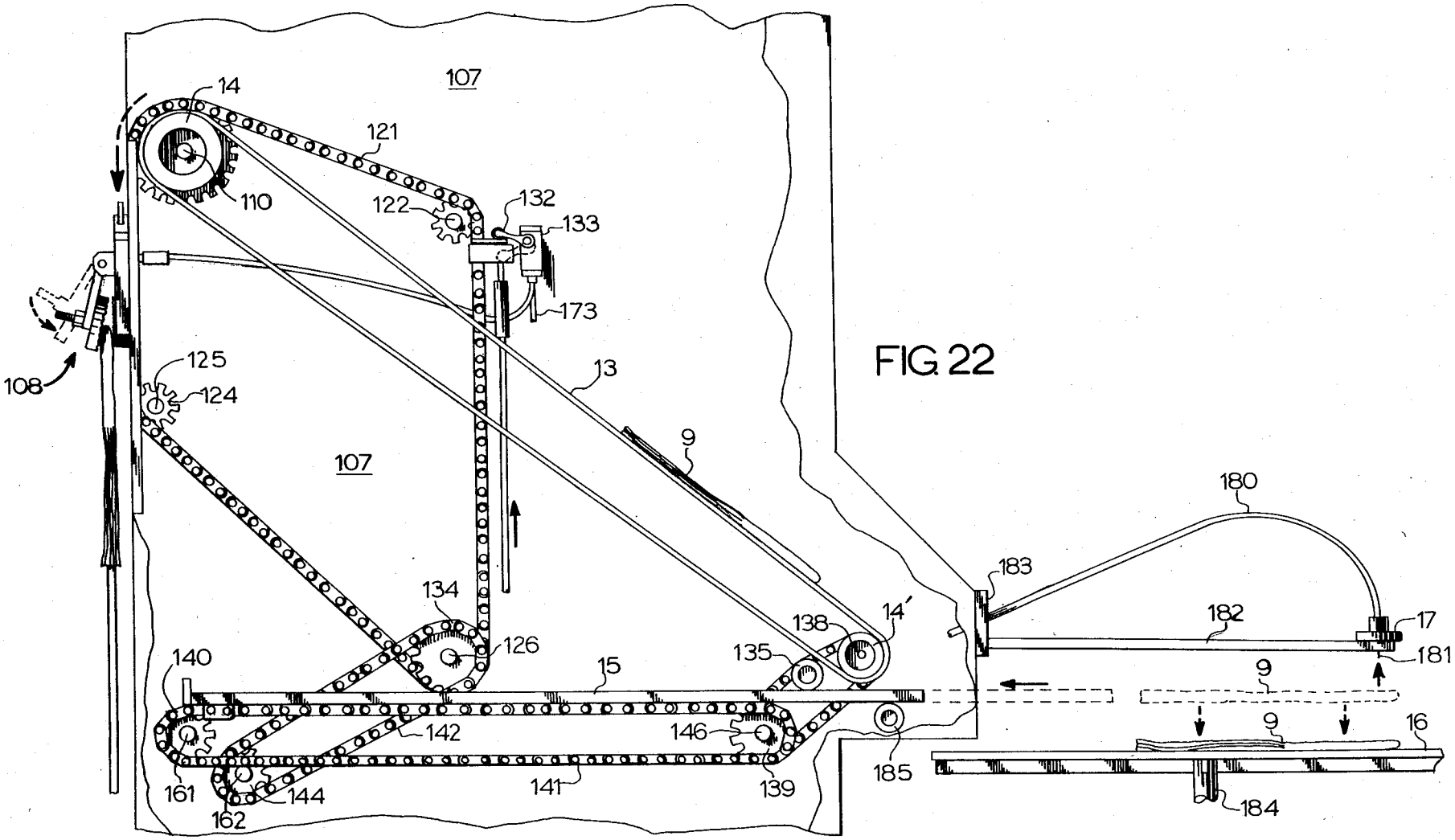
Figure 23:
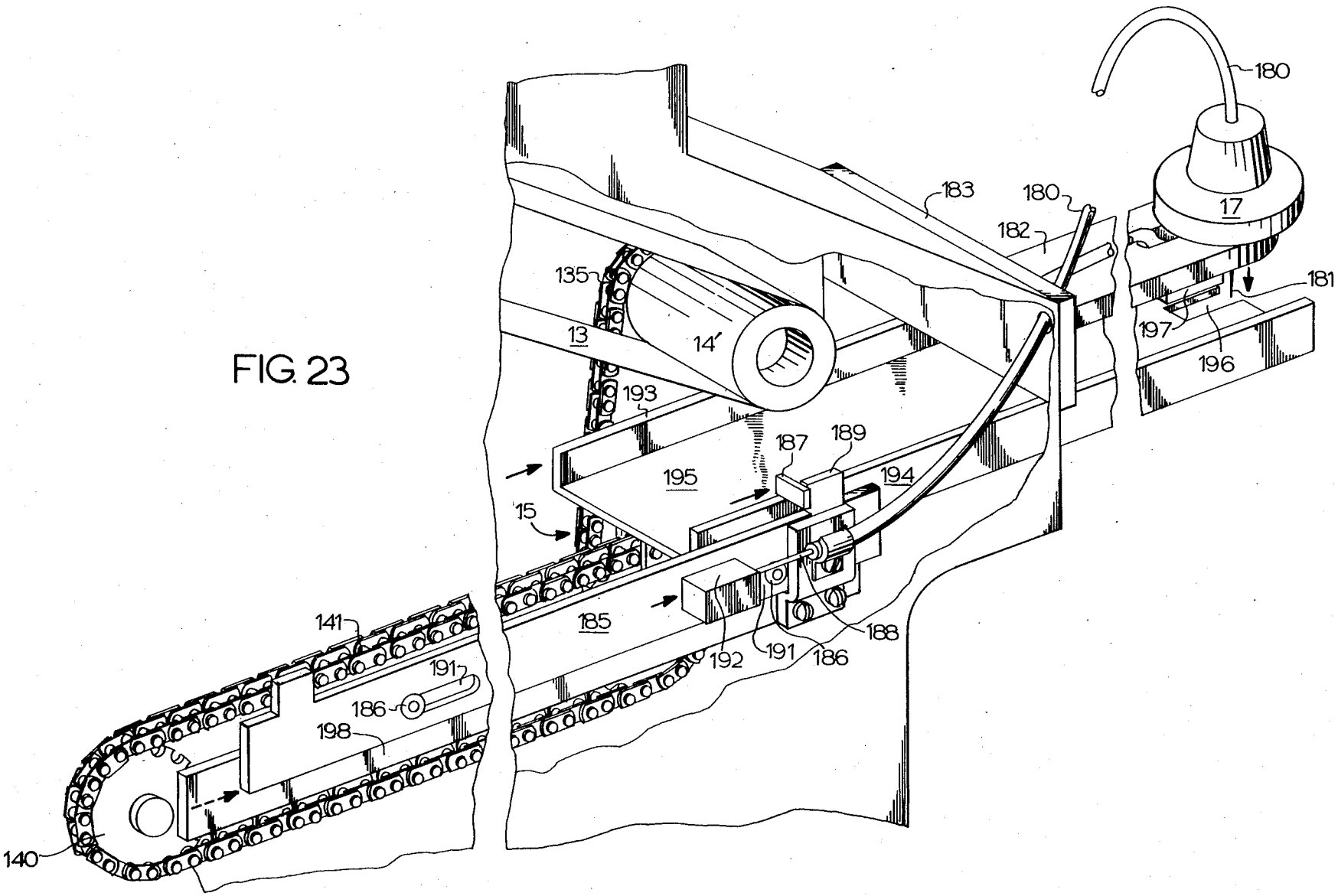
FIGS. 23 and 24 are fragmentary perspective views of a device for removing a sock from the tray of FIGS. 21 and 22.

Holder 17 is spaced apart from cross member 183 and attached to frame 107 by arm 182 whose length is such that holder 17 is positioned at the extended terminal right hand direction of travel of tray 15. Cable 180 is attached to holder 17 and is responsive to the movement of tray 15. FIGS. 21 and 22 respectively, show the position of needle 181 when tray 15 is in the extreme right then left hand position. Needle 181 protrudes through tray 15 through slot 196 in its bottom (see FIG. 23) when tray 15 reaches that position shown in FIG. 22, extending through sock 9 as it lies in tray. Slot 196 is adapted to receive and is aligned with needle 181. When in such a mode, needle 181 holds sock 9 in that position shown in FIG. 21 so that when tray 15 is moved from this position to the extreme left hand position as shown in FIG. 22, sock 9 drops onto flat receiver 16. Sock 9 is deposited in a stack of a predetermined number and counted by counter 197. Needle 181 is retracted after tray 15 moves to the left a predetermined distance (the length of sock 9) and then extended downward through sock 9 and slot 196 to "pin" the sock to the flat receiver 16 until tray 15 has cleared (retracted), stripping sock 9 from tray 15.

Tray 15 is composed of two side walls 193 and 194 and a bottom 195 with slot 196 in a terminal portion and rides on support means 198. Chain 141 is threaded over sprocket 139 and 140. Slot 196 is in alignment with needle 181 when tray 15 is extended fully to the right. Needle 181 is a reciprocating needle adapted to penetrate through sock 9 as it lies in tray 15. It is also adapted to penetrate through slot 196 and to impale sock 9 thereon while tray 15 is retracted from its extreme right hand to its extreme left hand position. The reciprocating movement of tray 15 causes needle 181 to retract and extend as a fucntion of the movements of slide bar 185. Slide bar 185 is slidably attached to support means 198 by means of studs 186, which are slidably received in slots 191, and is moveable between the lateral extremes of such slots. Studs 186 (affixed to element 198) have heads larger than the vertical dimension of slot 191 to slidably secure slide bar 185 to support means 198. Cable sheath 180 has nested inside of it a slidable flexible rod 188 one end of which is fixed in block 192 (affixed to slide bar 185) and the other end is affixed to or forms needle 181 position so as to create a freely moveable terminal portion. When slide bar 185 is moved to the left, rod 188 is also pulled in that direction to the extremities of slots 191. Simultaneously, needle 181 is retracted in the vertical direction by a likewise distance. When slide bar 185 is pushed to the right, rod 188 is pushed (extended) to the right and needle 181 is extended downward through sock 9 and slot 196. Thereafter, it is retracted by rearward (to the left) movement of slide bar 185. Movement of slide bar 185 is a function of the reciprocating movement of tray 15. Cross member 187 (affixed to tray 15 side wall 194) is adapted to abut against protrusions 189 and 189' of the slide bar to move it, cable 188 and needle 181 as previously described.

Figure 24:
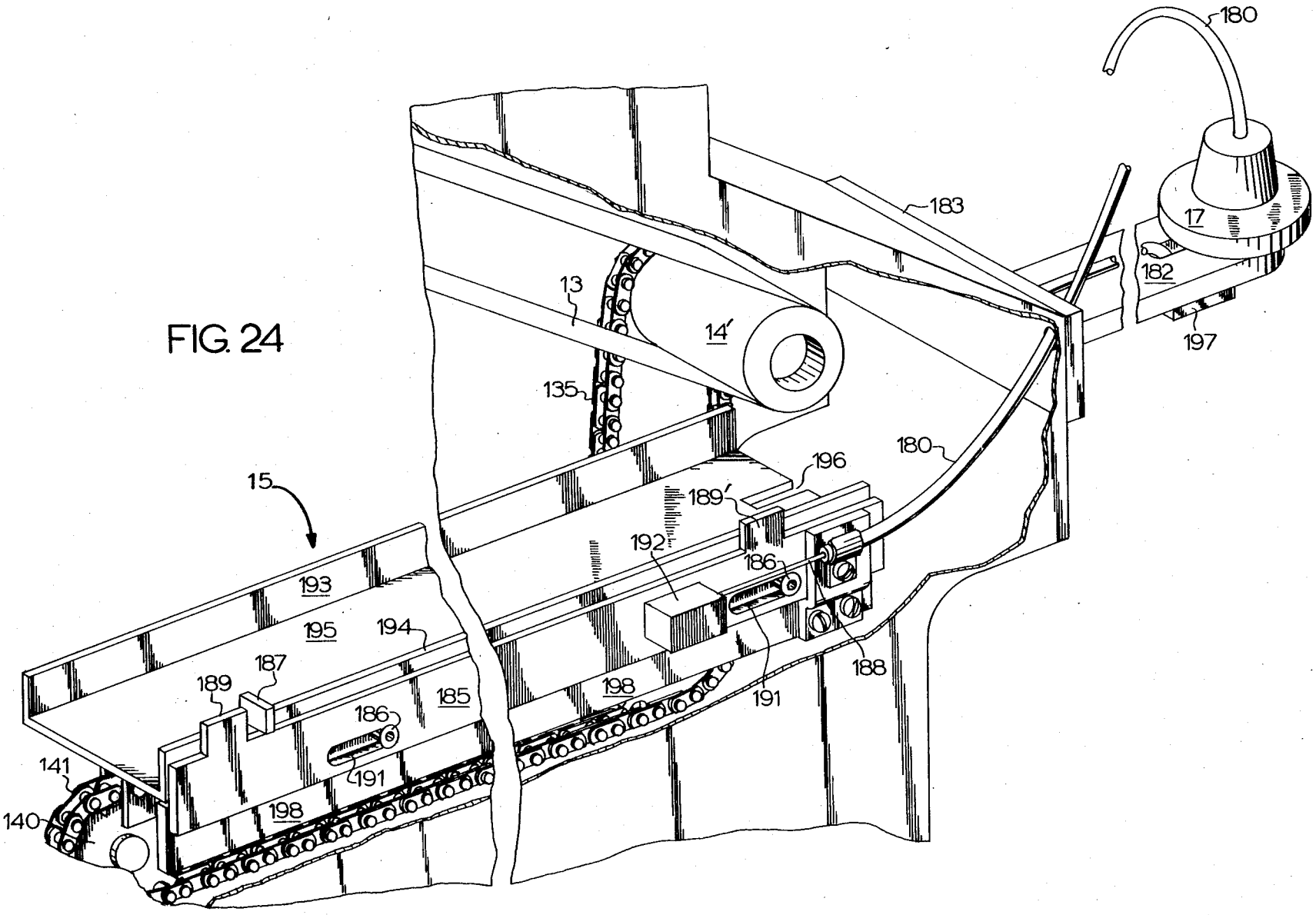

Support member 183 has an aperture therein through which cable sheath 180 is disposed. Photocounter 197, disposed on arm 182, is aligned with slot 196 so that a light beam from photocounter 197 will pass through slot 196. Photocounter 197 will not count when light passes through slot 196 (no sock) but will count when light passage is blocked, i.e. presence of a sock. When a predetermined number of socks 9 have been laid on top of one another to form a stack of socks on flat receiver 16, element 16 is indexed in a hereinafter described manner a distance sufficient to expose an unoccupied area on its upper surface sufficient to receive another stack of socks. Cross member 187 is affixed to tray 15 between upstanding members 189 and 189'. When tray 15 moves to the right (FIG. 23), cross member 187 abuts against upstanding element 189 moving slide bar 185 a distance (delimited by the longitudinal dimension of slots 191) to the right. When tray 15 moves to the left, upstanding tab 187 then abuts against upstanding member 189 thus moving slide bar 185 to the left a distance delimited by the longitudinal dimension of slot 191. See FIG. 24. Movement of tray 15 to the right extends needle 181 downward. Movement of tray 15 to the left retracts needle 181 as a result of the movement of slide bar 185, block 192 and cable 188.

Figure 25:
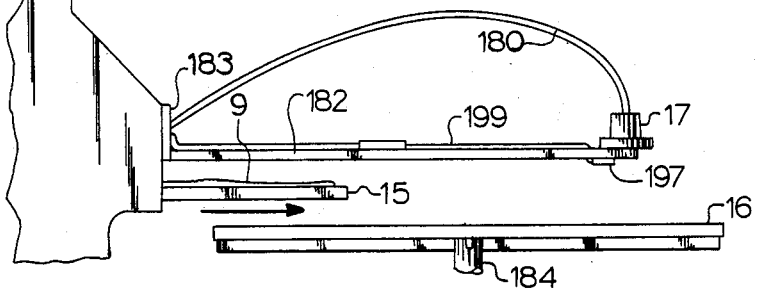
FIGS. 25, 26 and 27 are fragmentary sequential views of the apparatus and method used to strip a sock from tray 15 and deposit it on a flat receiver.
Figure 26:
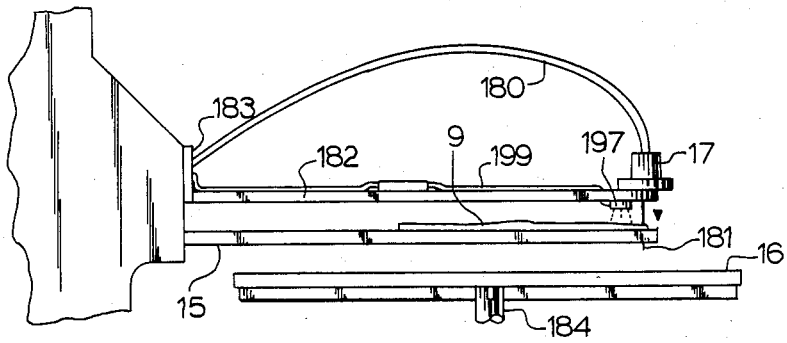
Figure 27:
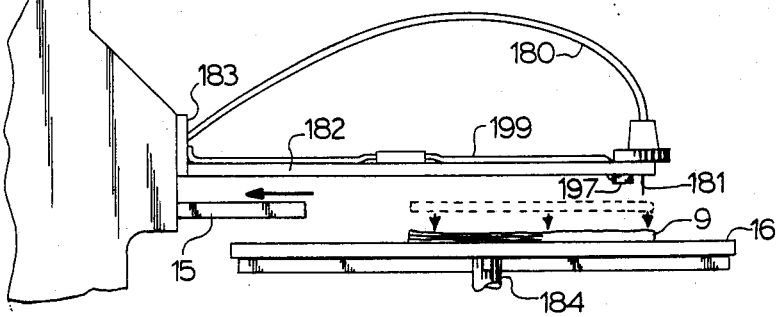
Figure 28:
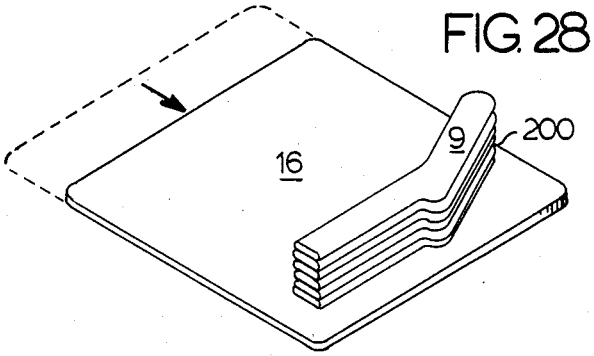
FIGS. 28, 29, 30 and 31 are schematic sequential views of the indexing, rotating and lowering of the flat receiver of FIG. 1 during the formation of more than one layer of stacked socks thereon.

FIGS. 25, 26 and 27 are demonstrative of the previously described method of stripping sock 9 from tray 15 by means of needle 181. Note in sequence FIGS. 26 and 27. In FIG. 27, tray 15 is retracted to its loading position, extreme left hand position (FIG. 24) there to receive another sock from belt 13 as previously described. After such receipt, tray 15 moves to the right (FIG. 25) and thus to its unloading position, its extreme right hand position. Socks 9 are unloaded from tray 15 one on top of another in a stack (see FIG. 28) until the stack consists of a predetermined number of socks 9. Photocounting means 197 counts the number of socks 9 and when the predetermined number is reached, flat receiver 16 is indexed (moved) by a hereinafter described means, a distance to the right (see FIG. 28) so that the area directly beneath tray 15 in its unloading position is sufficient to allow the unloading of another succession of socks to form another stack. This process is repeated until the upper surface of flat receiver 16 has a predetermined number of stacks of socks. Thereafter, element 16 is rotated 90°, lowered a distance equal to the height of a stack of socks and thereafter the process of sock stack formation, as previously described, is repeated to form a second layer of stacked socks the longitudinal axis of which lie perpendicular to the longitudinal axis of the underlying layer of stacked socks. After the second layer is created, element 16 is rotated 90°, lowered a sock stack height distance and then a third layer of socks is created. Layer after layer is laid down in the aforementioned manner, each oriented 90° to the preceding and/or subsequent layer until a predetermined height of "cross" stacks or sock layers is created. At this point, flat receiver 16 is removed with the layers of socks thereon replaced with another but empty element 16 and the unloaded flat receiver 16 is then raised to a given level. At this time, the process of loading element 15 with a plurality of layers of cross stacks of socks is repeated.

Figure 29:
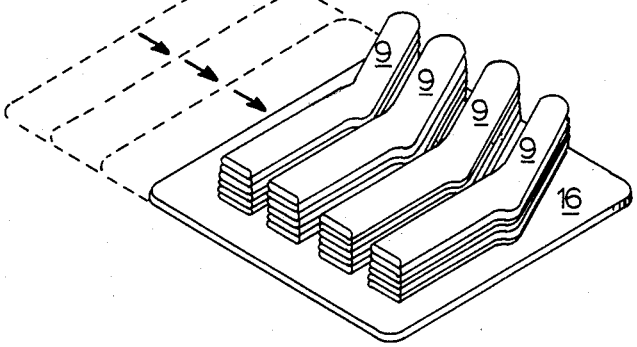
Figure 32:
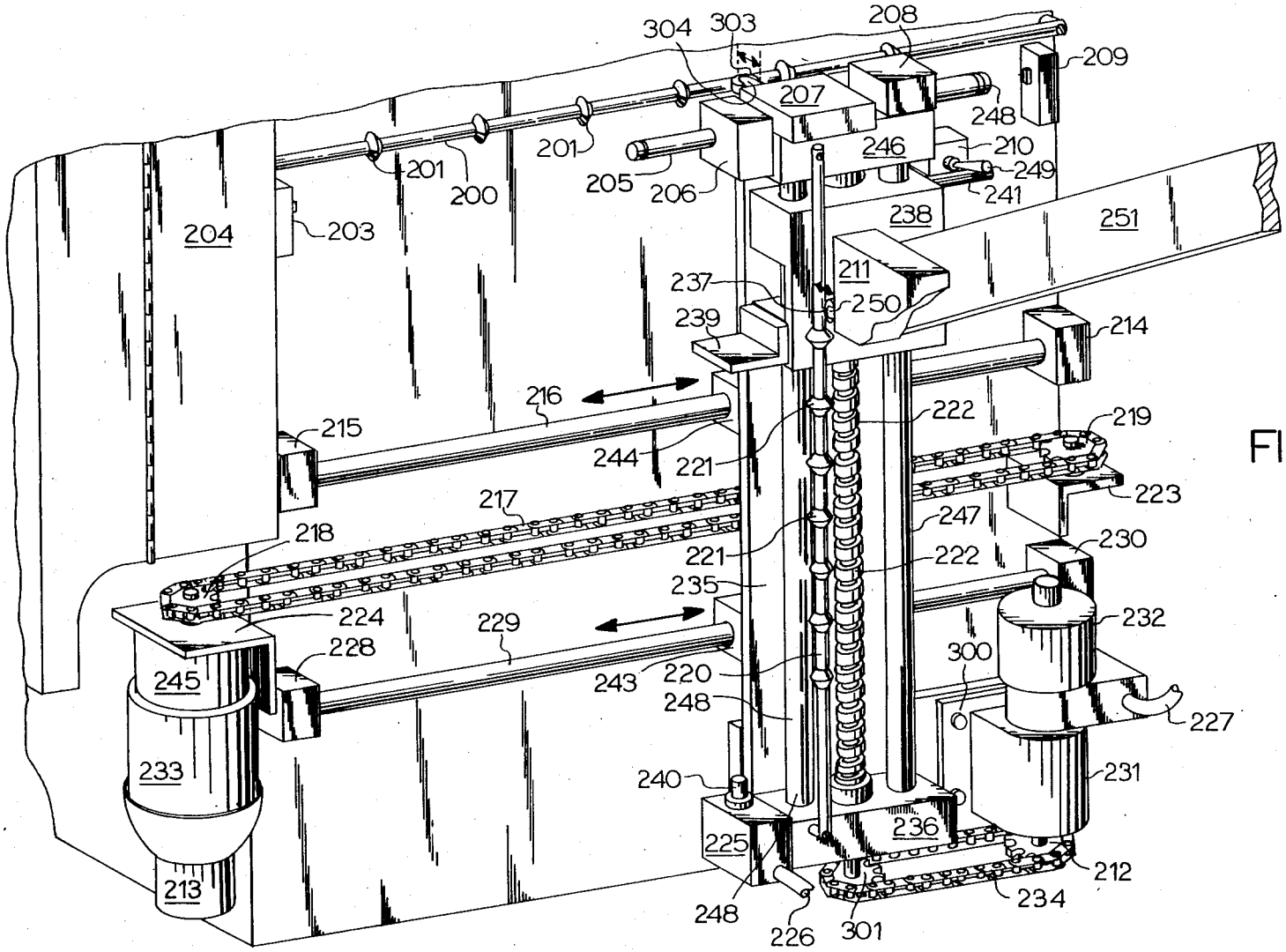
FIG. 32 is a partial perspective view of the control apparatus for indexing, rotating and lowering the flat receiver of FIG. 1.
Figure 34:
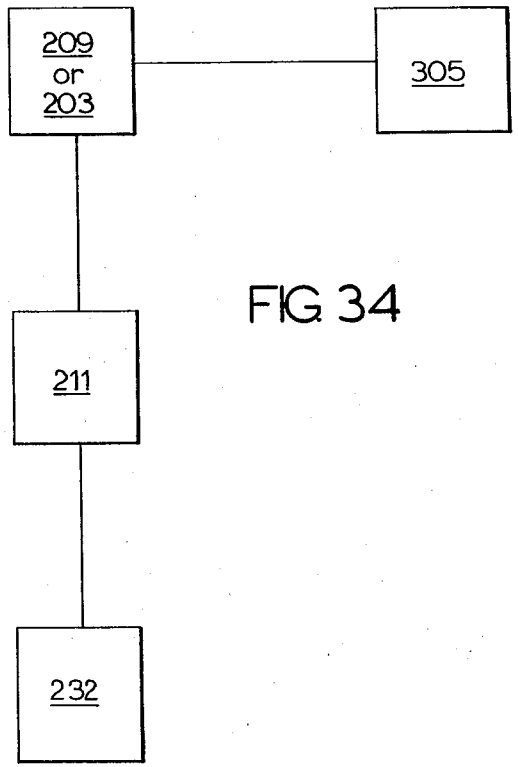
FIG. 34 is a schematic of a circuit composed of two time delay switches and a motor used to index downwardly the flat receiver of FIG. 1.
Figure 33:
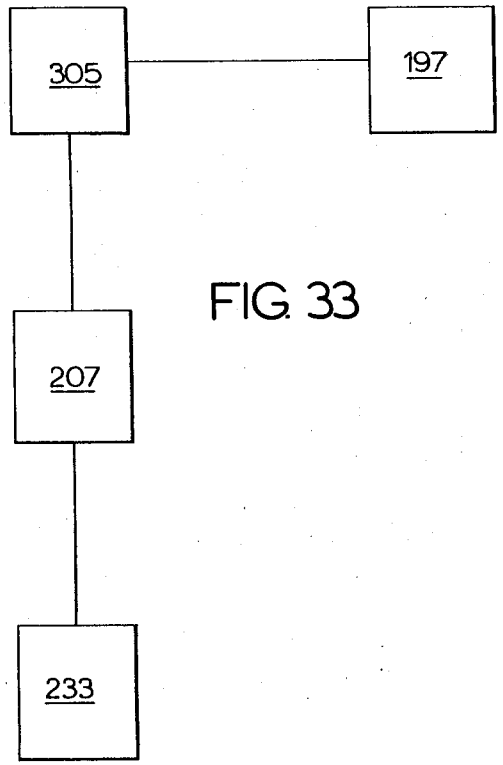
FIG. 33 is a schematic of a conductor-switch and photocounter circuit used to control the indexing and rotating of the flat receiver of FIG. 1.

Reference is now made to FIGS. 32, 33 and 34 for a description of the horizontal indexing, rotation, lowering and raising of flat receiver 16:

Photocounter 197 is in electrical connection with computer 305, which is in electrical connection with switch 207 and switch 207 is electrical connection with motor 233. This electrical circuit (FIG. 33) controls the indexing of flat receiver 16 in the manner shown in FIGS. 28 and 29, employing the following apparatus.

Receiving blocks 228 and 230 are attached to frame such as element 224. Affixed to receiving blocks 228 and 230 is transverse rod 229. Note also receiving blocks 214 and 215 with a like transverse rod 216 connected thereto. Rods 216 and 229 are slidably threaded into blocks 243 and 244 respectively and such blocks are affixed to an upstanding panel 235, which in turn is affixed to chain 217. Chain 217 is threaded over sprockets 218 and 219 and is driven by motor 233 and controlled by gear box 245 and brake 213. Sprocket is affixed to an axle (not numbered) journaled in support 223. Activation of motor 233, as hereinafter discussed, causes upstanding panel 235 to move (index) to the left or to the right as the case may be, the indexing shown in phantom lines in FIGS. 28 and 29. Affixed to upstanding panel 235 are end blocks 236 and 246. Affixed to such end blocks and spaced apart from panel 235 are upstanding rods 247 and 248. Threaded onto upstanding rods 247 and 248 is block 238. Affixed to block 238 is protrusion 239 in alignment with switch means 225 which is affixed to block 236. Acutator 240 forms a part of switch 225. Affixed to and spaced apart from block 236 and 246 is upstanding rod 220 on which there are plurality of equally spaced apart protrusions 221. The function and interaction of rod 220 and switch 211 and switch actuator 237 will be explained later. The terminal ends of upstanding screw member 222 are journaled in blocks 236 and 246 respectively. The lower end of upstanding screw member 222 protrudes below the lower free surface of block member 236 and is affixed to sprocket 301. Threaded over sprockets 301 and 212 is chain 234. Sprocket 212 is affixed to the shaft (not numbered) of gear box 231, which controls motor 232. Element 227 represents an electrical conduit for the power to run motor 232. Motor 232 and gear box 231 are affixed to base 300, which is affixed to panel 235 and end block member 236. Motor 232 thus "rides" left and rightwardly with the movement of panel 235. This is the means to move element 16 in the "X" direction.

Activation of motor 232 through gear box 231 drives chain 234, which rotates sprocket 301 and upstanding screw member 222. Matching and meshing threads on the interior of block 238 (not shown) into which upstanding screw member 222 is threaded causes block 238 to slide along upstanding rods 247 and 248 in an upward or downward fashion, depending on the direction of rotation of chain 234 and the resulting respective rotation of upstanding screw member 222. Block 238 and switch 211 are affixed to support 251. Acuating arm 237 of switch 211 is adapted to rotatingly abut against upstanding rod 220 and protrusions 221 thereon. Affixed to end block member 246 are block and protrusion 206 and 205 respectively aligned with limit switch 203, which is affixed to upstanding frame 204. Likewise, block 208 and protrusion 248 respectively are aligned with limit switch 209. Manually operable switch 210 is affixed to block 246, which has thereon a manually operable toggle arm 249 adapted to turn switch 210 to the "off" postion. In "on" position motor 232 is activated to drive (rotate) screw 22 so that block 238 travels upwardly. Turning switch 210 to the "off" position stops such upward travel by deactivating motor 232. Block 238 has a laterally extending protrusion 241 positioned and aligned with toggle arm 249 so as to abut against same on its upward travel and to move toggle arm 249 from a first "on" to a second "off" position to deactivate motor 232 and stop the upward travel of block 238. This is the means to move element 16 in the "Y" direction.

Figure 31:
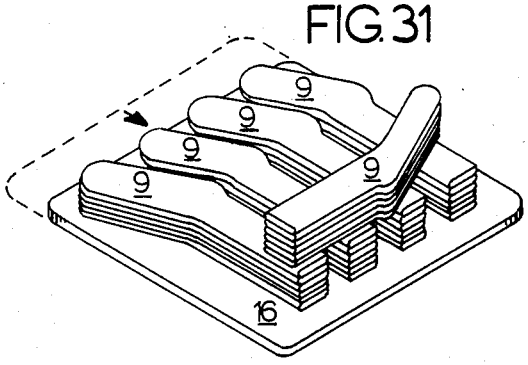

After block 238 (through indexing) has reached its lowermost position, i.e. adjacent to block member 236 (as hereinafter described), protrusion 239 contacts and depresses actuator 240 in switch 225, rendering switch 225 from "on" to its "off" position. Such an action removes power from all of the sock boarding machine tracks, namely, tracks 10, 11, 12, the flaccid article removal mechanism, belt 13 and tray 15 apparatus. In other words, the entire apparatus, apart from the heating element and the fans associated therewith come to a halt. At this stage, flat receiver 16 is at its lowermost position, is loaded to its capacity with layers of stacks of socks (see FIG. 31) and is ready for removal and replacment with an empty one. The operator, usually standing at position "X" (FIG. 1) and realizing that the flat receiver is full when all tracks are stopped. The operator then replaces the full flat receiver 16 with an empty one. After so doing, the operator then moves toggle arm 249 to the "on" position, causing motor 232 to operate, screw 222 to rotate and block members 238 to travel from the flat receiver 16 "loaded position" (adjacent block 236) up to its "unloaded position" (adjacent block 246), at which position flat receiver is ready to be loaded with stacks of socks 9. When activator 240 of switch 225 is rendered to its extended position (FIG. 32) a circuit is completed reactivating the parts of the sock boarding machine previously deactivated by depressing actuator 240.

Figure 35:
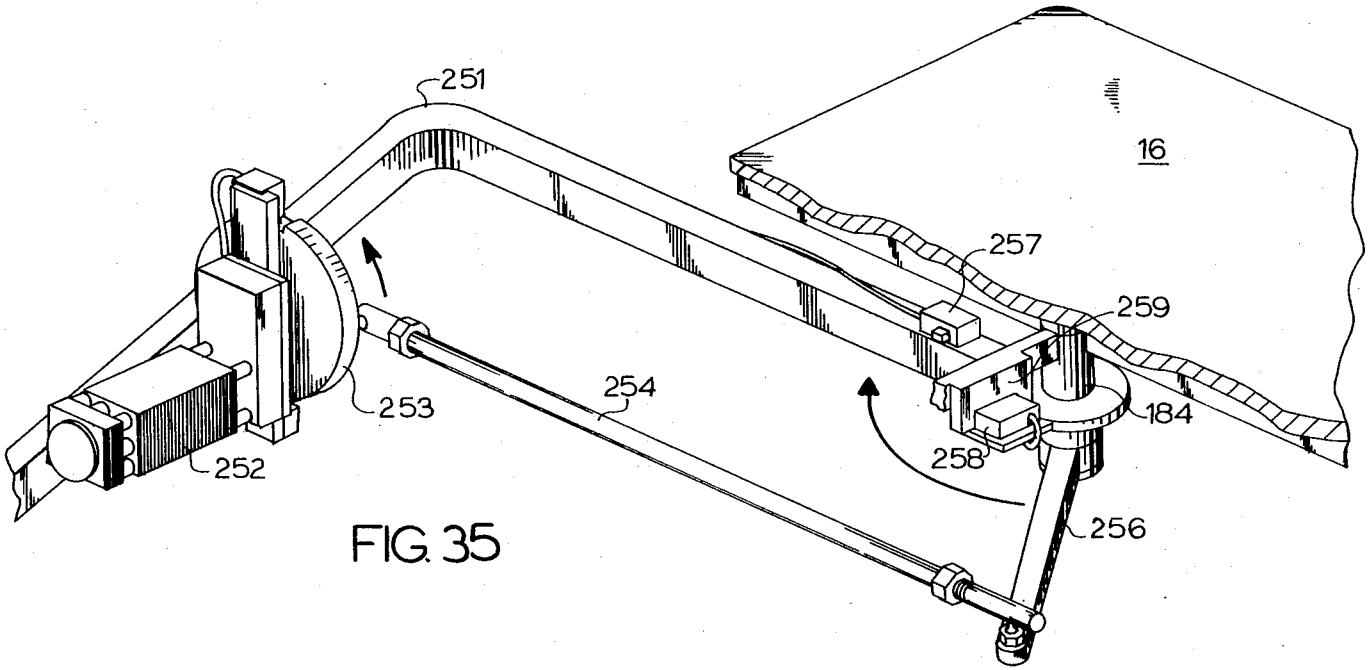
FIG. 35 is a partial perspective cut-away view of the apparatus employed to rotate the flat receiver of FIG. 1.
Figure 36A:
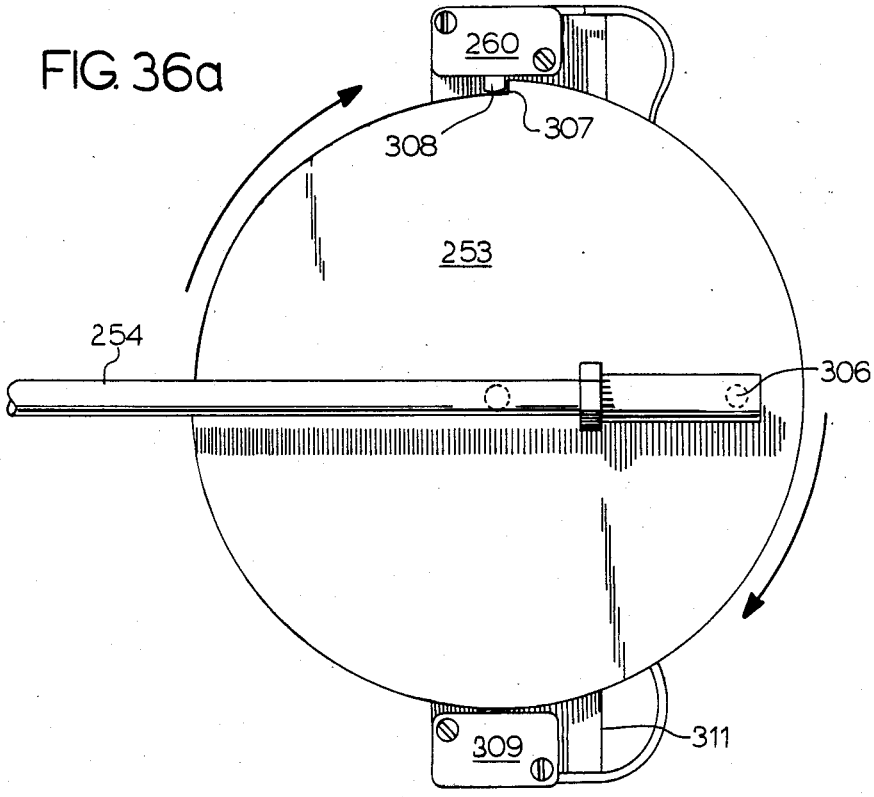
FIGS. 36*a* and 36*b* are detailed partial views of a cam and arm mechanism of FIG. 35 used to rotate the means for rotating the flat receiver.
Figure 36B:
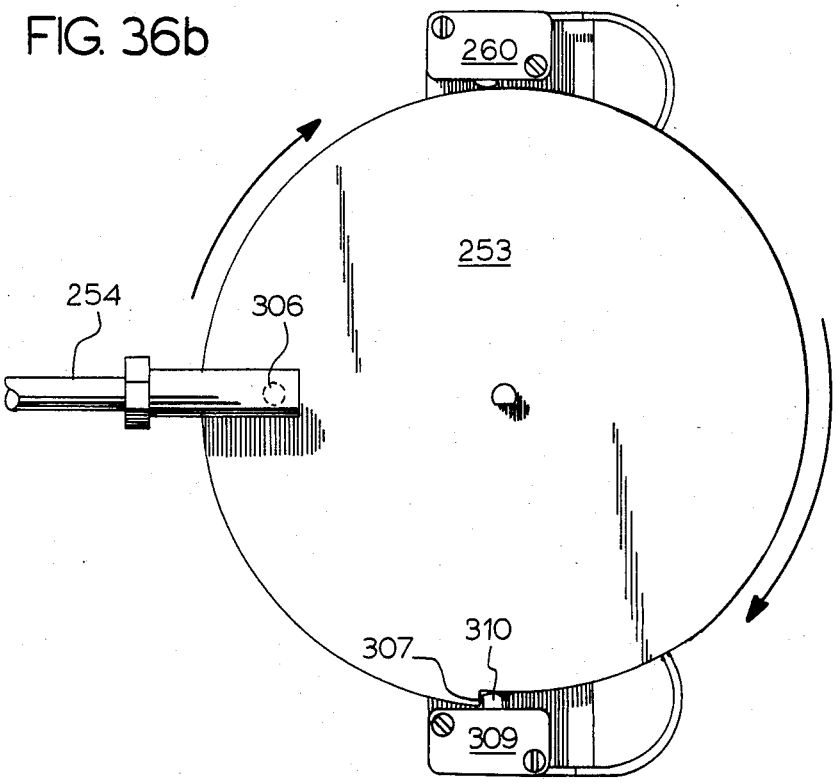

Turning now to switches 203 and 209: When panel 235 and block member 246 are moved (by means of chain 217 and motor 233) to either the extreme right or left as a result of a yet to be explained indexing process (see FIGS. 28 and 29) either protrusion 205 strikes switch 203 or protrusion 248 strikes switch 209 (as the case may be) turning such respective switches from an "off" to an "on" position, resulting in the momentary and timed activation of motor 252, which rotates cam plate 253 180°. See FIGS. 35 and 36*a* and 36*b*. Switches 260 and 309 are in the same electrical circuit (not shown) with switches 203 and 209 and are in parallel with each other. When actuator 308 is in recess 308, switch 260 is in the "OFF" position. When actuator 308 of switch 260 is compressed (see FIG. 36*b*) it is in the "ON" position. The same applies to switch 309 and its actuator 310. Both switches are mounted on bar 311 which is held stationary. When limit switch 209 is activated, motor 252 causes cam 253 to rotate in a given direction. It rotates only 180° because of the coaction of recess 307 and actuator 310 of switch 309. When limit switch 203 is actuated, motor 252 is again activated causing cam 253 to rotate, again limited to 180° because of recess 307 and actuator 308 of switch 260. Thus, when switch 209 is activated, flat receiver 16 is rotated 90° and when switch 203 is activated, flat receiver 16 is rotated again 90°, all by means of cam 253, arms 254 and 256.

Figure 30:
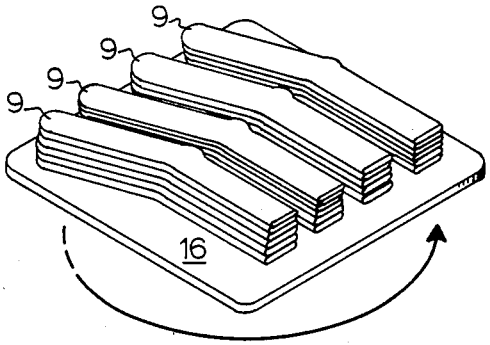

Arm 254 is rotatably linked with arm 256 and rotatably journaled in cam 253 at point 306. Arm 256 is affixed to support 184, which is affixed to flat receiver 16. Movement of rod 254 to the right causes arm 256 to rotate which in turn causes support 184 to rotate. Rotation of cam 253 180° causes rod 254 to move arm 256 a distance sufficient to rotate flat receiver 16 90° as shown in an exemplary fashion in FIG. 30. Movement of rod 254 to the left causes arm 256 to rotate which in turn causes support 184 to rotate. Rotation of cam 253 180° causes rod 254 to move arm 256 a distance sufficient to rotate flat receiver 16 90° . Such action comes about after a layer of stacked socks have been laid down, either directly on the flat receiver 16 itself and/or on another previously deposited layer of sock stacks. See FIG. 31 for example. After rotation, switch 209 or 203 (as the case may be) automatically returns to its normally "off" state, to be reactivated only (for a predetermined period of time) after being struck again by protrusion 248 or 205 as the case may be. Rotation of arm 256 causes arm 259 (affixed to support member 184) to rotate and activate either switch 257 or 258, as the case may be. Activation of such causes motor 233 to reverse direction of rotation. Such action causes panel 235 to then travel in a reverse direction.

It will be noted that actuator 303 of switch 207 has a roller means 304 on its terminus. A like structure exists with switch 211. Note roller means 237 and actuator 250. Both roller means 304 and 237 are so adapted to be in rolling continuous contact with respective rods 200 and 220, each such rod having spaced apart protrusions 201 and 221 thereon respectively. Both switches 211 and 207 work in the same manner, with switch 207 controlling the indexing of flat receiver 16 in a horizontal left to right and right to left direction (see FIGS. 28–29), as the case may be, (the "X" direction) and switch 211 controlling the downward indexing (vertical) of element 16 (the "Y" direction). After flat receiver is rotated 90° as previously explained, as a function of the activation of either switch 203 or 209, element 16 via element 251 is lowered a predetermined height a height, essentially equal to a stack of socks, e.g. 6 socks. This incremental lowering is controlled by switch 211, rod 220 and protrusions 221. Block 238 and support member 251 are lowered a predetermined distance once end block member 246 is moved (indexed) to either its extreme right or extreme left handed position, at which time rotation and lowering takes place.

Helpful to the understanding of the mechanism of FIG. 32 is an understanding of the basic components and operation of switches 207 and 211, both of which are time delay switches and operate in the same manner. Each such switch is described in detail is U.S. patent application Ser. No. 633,358 filed July 23, 1984 entitled Time Delay Switch, now U.S. Pat. No. 4,552,999 issued November, 1985 and is composed of a housing containing an actuating means, a biasing means, a switch and a pneumatic means wherein part of the actuating means is disposed outside and a part inside of the housing and is movable from a first (extended) to a second (depressed) position by the part located outside of the housing. See elements 304 and 303 as well as elements 237 and 250 of switches 207 and 211 respectively. The biasing means is attached to that part of the acutating means located inside of the housing and to the housing to bias the actuating means towards the first position. The switch means (inside elements 207 and 211) is in a first state (either "off" or "on") when in contact with the pneumatic means and in a second state (either "off" or "on") when not in contact with the pneumatic means. The pneumatic means (also inside of 207 and 211) is aligned with the switch means and is adapted to be in compressed, intermediate and expanded states. When in its compressed and expanded states, it is contact with the switch and when in its intermediate state (between compressed and fully expanded mode), it is not in contact with the switch. Switches 207 and 211 are constructed so that the switch is conductive ("on") when arm 304 or 250 are fully depressed and fully extended. When these arms are in their fully extended position and then depressed, the switch goes from a normally "on" to an "off" to an "on" mode. When going from a fully depressed to a fully extended position, they stay in an "on" because the pneumatic means remains in contact with the switch after rendering it from the "off" to the "on" position. The period of time these switches are in the "off" position is variable, e.g. approximately four and a half seconds.

With the foregoing as background, attention is now directed to the coaction between switch 207 and tranverse rod 200. Motor 233 is connected to switch 207, which in turn is connected to computer 305. Photocounter 197 is connected to computer 305, shown schematically in FIG. 33. Computer 305—programable for a predetermined time period to have closed contacts to complete a circuit to motors 232 and 233 via switches 211 and 207 respectively—is responsive to photocounter 197 to turn on motor 233 (assuming switch 207 is conductive) to move panel 235 a predetermined lateral distance or turn on motor 232 (assuming switch 211 is conductive) to move panel 235 a predetermined vertical distance. Applicant has found that no available computer or single switch is capable of bringing the mass represented by panel 235 and the items attached thereto to a dead halt on command. Applicant has found, however, that the combination of a computer and switch (like that of elements 207 and 211) will achieve the desirable end results.

The process is as follows: Element 197 sends out a signal after it has counted a predetermined number of socks (e.g., 6 socks) causing contacts (not shown) in element 305 to momentarily close, thereby completing a circuit through switch 207 to motor 233 to activate it. Such contacts remained closed only for a predetermined period of time, e.g. 3.5 seconds. While such contacts are closed, motor 233 is activated, assuming switch 207 to be in its normally "on" position. In such a state, panel 235 is moved laterally. Switch 207 is wired so that in its "off" position, it deactivates motor 233 and in its "on" position allows motor 233 to operate. Switch 207 is in its normally "on" position when roller 303 is in contact with rod 200 and protrusion 201. As roller 303 and the actuator arm 304 change position from rod contact to protrusion contact (extended to compressed state) actuator arm 304 is depressed. For a predetermined period of time after depression (actuator arm going from fully extended to fully depressed state) the switch inside of switch 207 is in an "off" mode, e.g., for a period of time, say 4.5 seconds. Thereafter (after the expiration of the 4.5 seconds), it returns to its normal "on" position. Switch 207 "times out" after the contact in computer 303 also "times out," i.e., contacts of computer open, causing upstanding panel 235 to stop "dead" on the selected protrusion 201. Shortly after switch 207 "times out" of its off position, it returns to its "on" position. However, prior to that, the contacts in computer 305 open thereby breaking the circuit. Only after reactivation by photocounter 197 will the computer contacts close again. Computer 305 opens its contact ("times out") in the neighborhood of 3.5 seconds, for example.

When switch 209 is activated, usually after six (6) socks are deposited on flat receiver 16, a signal is sent to motor 232 and 252 simultaneously to reverse direction of travel from the direction of travel that it recently exhibited. Furthermore, on activation of switch 209, (which will be remembered causes flat receiver 16 to rotate 90°) a circuit is completed through computer 303, motor 232, switch 211, causing activation of motor 232. The co-action of switch 211, actuator 250 in combination with upstanding rod means 220 and protrusions 221, causes indexing of receiving means 16 via supporting arm 251 downwardly until protrusion 239 contacts actuator means 240 of switch 225, which causes all of the track means to come to a dead halt. At that point the operator removes the fully layered flat receiver 16 and replaces it with an empty one and activates toggle switch 249 to return the flat receiver to its "unloaded position," namely that position where block means 238 is in its uppermost position. The combination of switches 209 and 203, computer 305, motor 232 and switch 211 operate in a manner similar to the combination of computer 305 photocounter 197 and motor 232.

Upon activation of either switch 209 or 203, the contacts of computer 305 close for a predetermined length of time (3.5 seconds for example) completing a circuit through switch 211. This switch (normally in the "on"position) then completes a circuit to motor 232, causing rotation of screw 222 and a lowering of block 238. When element 237 of switch 211 strikes protrusion 221, switch 211 is rendered momentarily to the "off" position (for 4.5 seconds for example) because actuator arm 250 is moved from its fully extended to its fully depressed state, i.e., the switch goes from a normally "on" to a momentarily "off" then to an "on" position. Going from the protrusion 221 to rod 220 roller 237, arm 250 goes from the fully compressed to the fully extended state, however, during such time, switch 211 stays in the "on" position because the pneumatic means (not shown) inside of the switch stays in contact with the switch (inside switch 211) to keep it in the "on" position. By the time the "off" position of this switch "times out," computer 305 has already timed out, i.e., its contact are open, not to be reactivated until protrusion 248 strikes switch 209 or protrusion 205 strikes switch 203. Thereafter the process is repeated, indexing block 238 and flat receiver 16 downward a predetermined distance until switch 255 is activated by protrusion 239.

Figure 46:
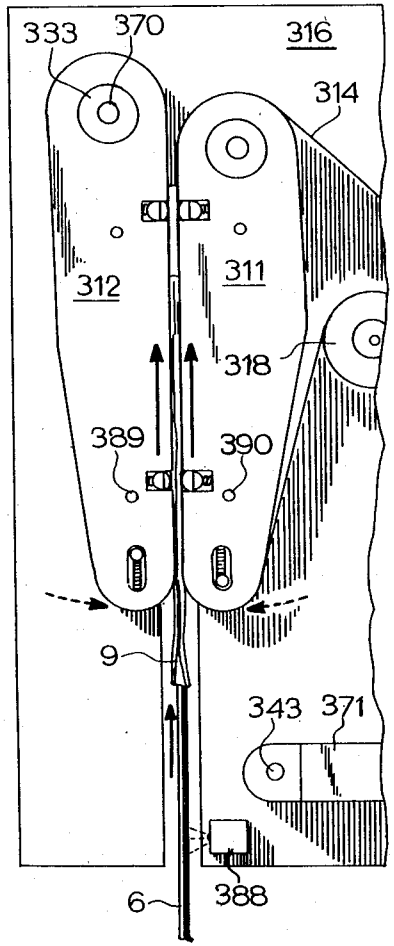
FIGS. 44, 45, and 46 are front elevation views of the sequential operation of removers 311 and 312 showing open position (FIG. 44), receiving board 6 and sock 9 (FIG. 45) and closing and stripping sock 9 from board 6 (FIG. 46).
Figure 45:
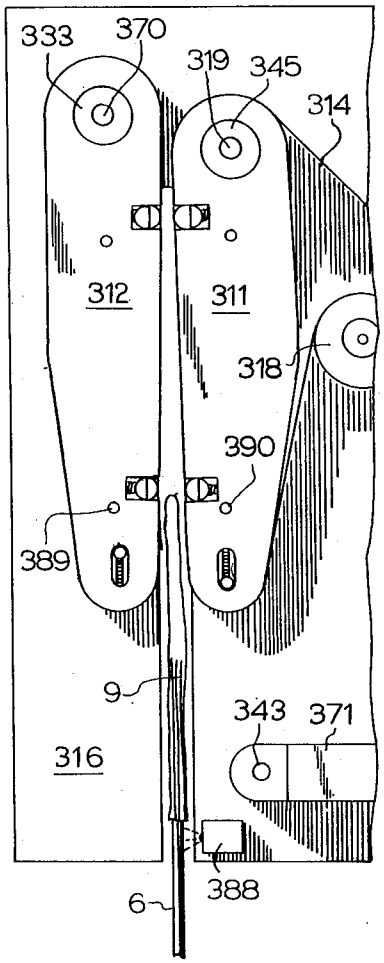
Figure 44:
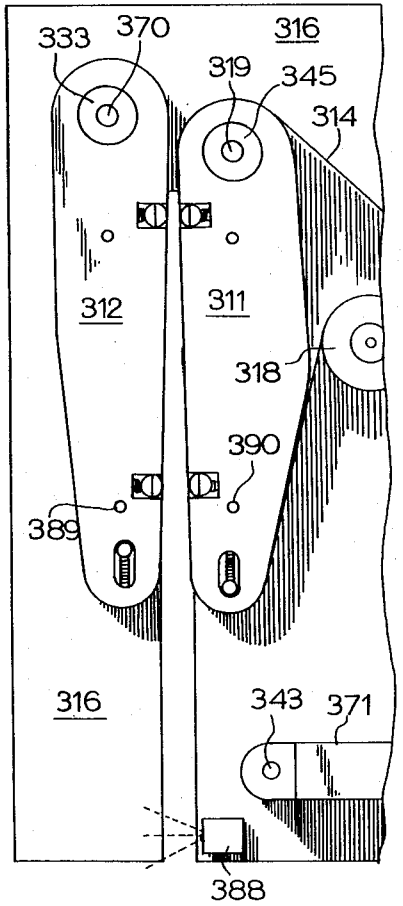
Figure 47:
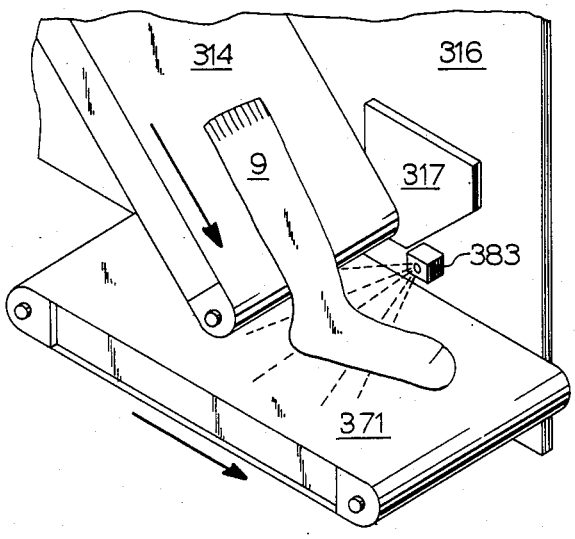
FIGS. 47 and 48 are perspective views of how sock 9, once stripped and deposited on belt 314, is laid on belt 371, detected, and extension of belt 371 in response to the detection.

The take off and stacking mechanism (first embodiment) shown in FIGS. 12 through 36(*b*) can be replaced in its entirety by a second take off embodiment shown in FIGS. 37 through 50. This second embodiment is depicted generally in FIGS. 37 and 38 and comprises an upstanding base 316 with slit 313 therein. Part of base 316 sits astride track 10 to the extent that slit 313 is aligned with the travel path of boarding form 6 and of course heating chamber slit 4. Disposed along side slit 313 are removers 311 and 312, both of which are pivotally mounted to base 316 so that they can be moved from a first (open) to a second (closed) position. See FIGS. 44 through 46. In the closed position, the removers are so positioned one to another and along slit 313 so that their respective innermost surfaces come in contact with sock 9 on boarding form 6. Since remover 312 (second continuous belt) is circumscribed by continuous belt 315 (continuously traveling counterclockwise) and remover 311 (third continuous belt) is partially circumscribed by belt 314 (continuously traveling clockwise), convergence of removers 311 and 312 causes sock 9 to come in contact with continuous belts 314 and 315 and because of their respective directions of rotations, sock 9 is stripped (removed) from boarding form 6 and is deposited on belt 314. This last-mentioned action (deposition of sock 9 on belt 314) comes about because the upper terminal portion of belt 314 is lower with respect to the like portion of belt 315. Removers 311 and 312 are pivotally attached to base 316 by axles 319 and 320 respectively.

Figure 38:
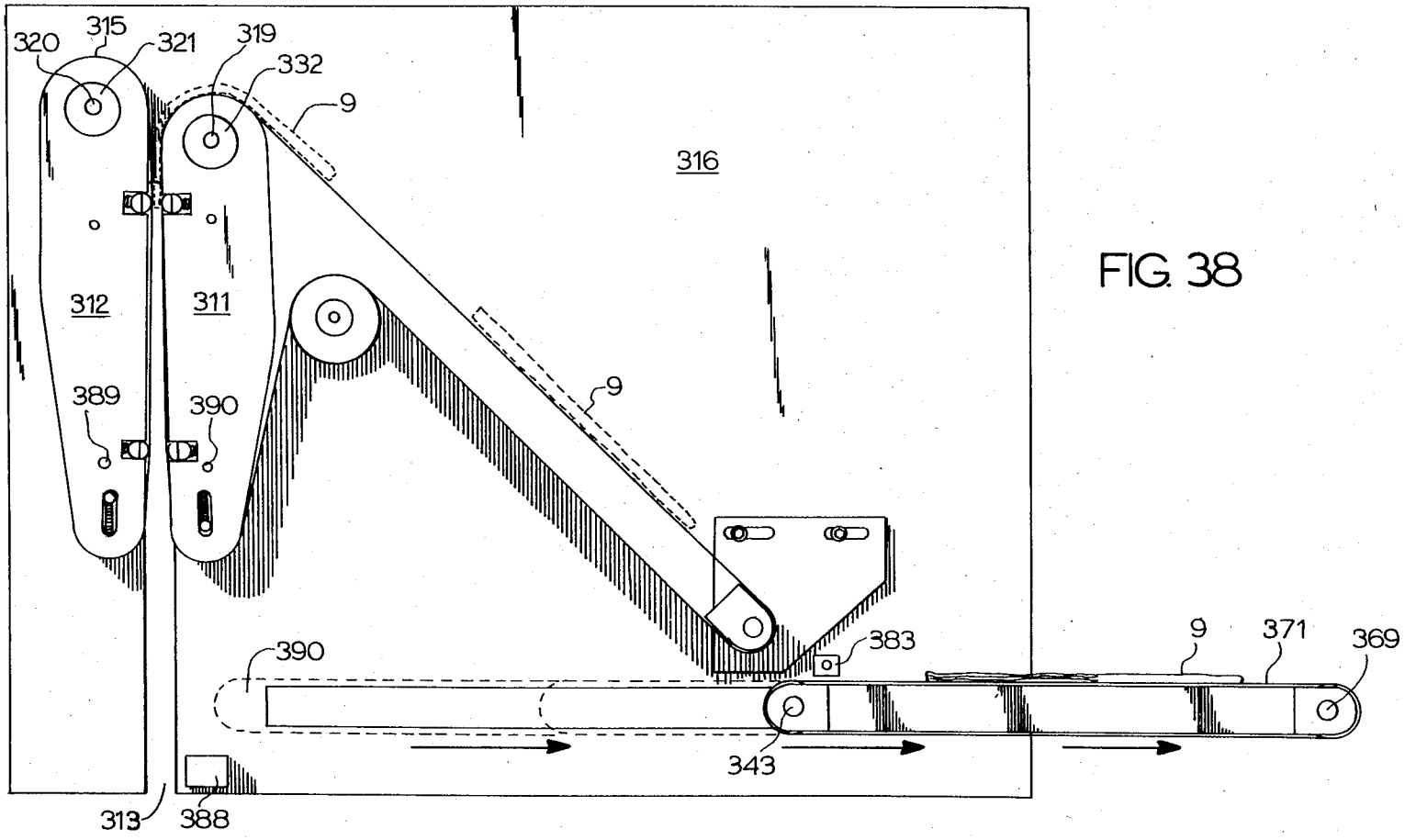
FIG. 38 is a front elevation of the second embodiment of FIG. 37 showing belt 371 in an extended (second) position.
Figure 39:
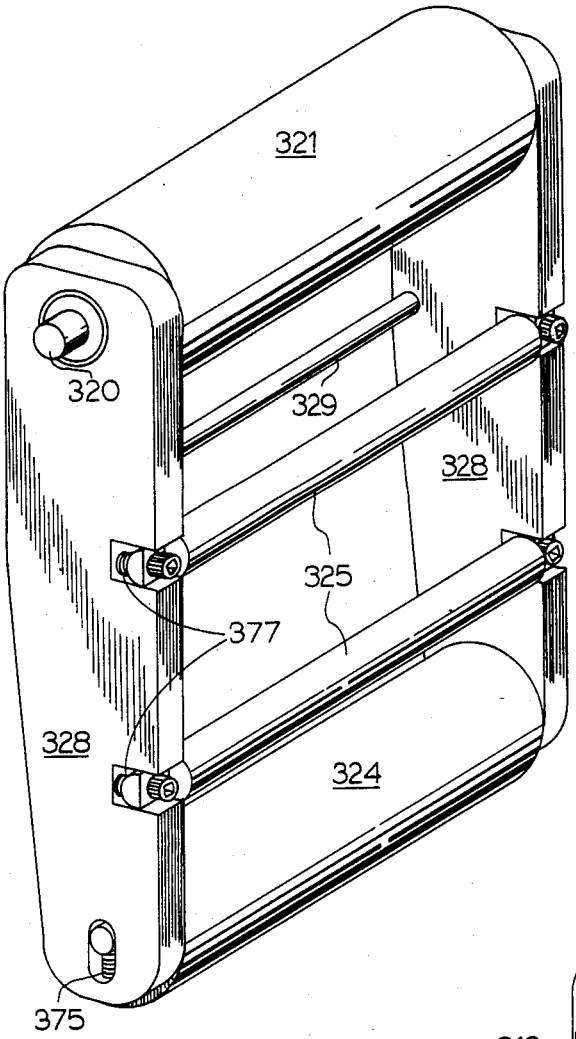
FIGS. 39 and 40 are perspective views of the structure of the removers (elements 311 and 312) of FIGS. 37 and 38.
Figure 40:
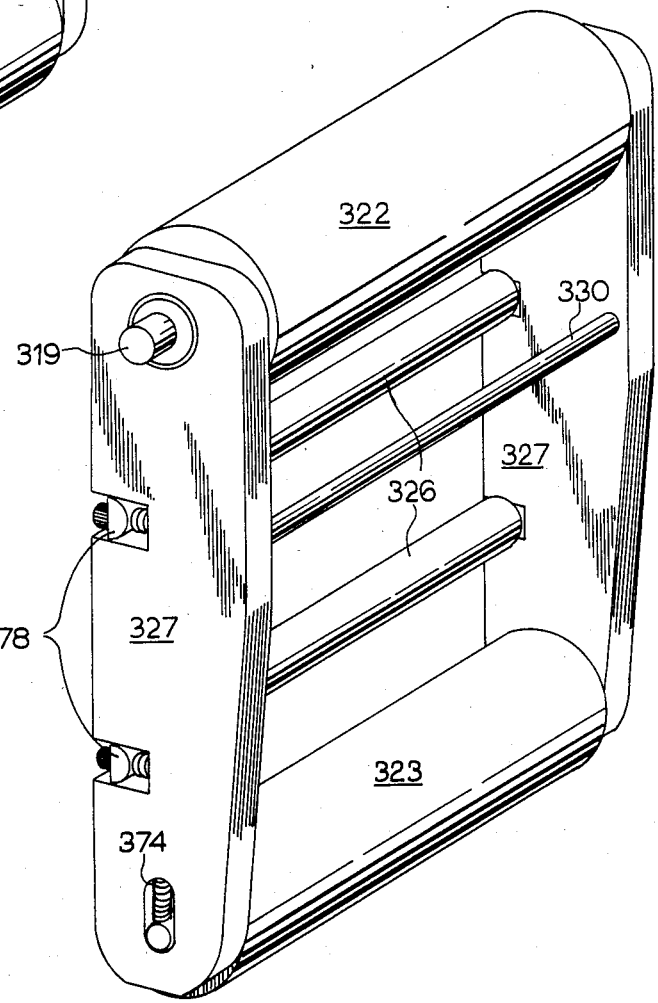

The construction (without their respective belts) of removers 311 and 312 (first and second tracks) is shown in FIGS. 39 and 40. Both removers have essentially the same basic structure, except that one is a "left handed" and the other is a "right handed" version. Compare elements 327 and 328 of FIGS. 40 and 39 respectively. Both have end members (elements 328 and 327) spaced apart from one another by spacer rods 329 and 330. Each have upper rollers (elements 321 and 322) and bottom rollers (elements 323 and 324). Elements 323 and 324 sometimes called, first and second elongated tracks, are spring-loaded (see elements 374 and 375). This can also be said for rollers 326 and 325. See springs 377 and 378. Continuous belt 315 is threaded over rollers 321, 325, and 324 to form remover 313 and continuous belt 314 is threaded over rollers 322, 326 and 323 to form remover 311. In addition, however, belt 314 is also threaded over a pulley (not shown) affixed to axle 370 and to rotatable idler pulley 318, which is also a belt tensioning device. Axle 370 is journaled in plate 317, which is adjustably affixed (see slots 379 and bolts 380 affixed to base 316). Disposed beneath axle 370 and the lowermost terminal portion of belt 314 is horizontally disposed take-away belt 371, which is threaded over pulleys (not shown) that are affixed to axles 343 and 369. Frame 372 is also affixed to axle 343 and 369 and covers the aforementioned pulleys. As will be more fully explained later, take-away belt 371 (along with axles 343 and 369) are adapted to be reciprocated from a first (see FIG. 37) to a second position (see FIG. 38) and then from the second back to the first position.

Sock 9 is stripped from board form 6, deposited on belt 314, then on to belt 371 (fourth continuous belt). When sock 9 begins its transfer from belt 314 to belt 371, belt 371 begins its lateral travel from its first to its second position. This co-action between belt 371 and 314 "lays out" sock 9 in a longitudinal fashion on belt 371 (see FIGS. 47 to 48). During this time, belt 371 is not rotating. However, when belt 371 reaches its second position (FIG. 48) it is ready to deposit sock 9 on a receiver (element 391) and then be moved from the second to its first position. Deposition of sock 9 on receiver 391 is achieved by causing clockwise rotation of belt 371 simultaneously with its movement from its second to its first position. The mechanism used to achieve this is shown in FIG. 41, which is reverse or back side of the view of upstanding base 316 first shown in FIG. 37.

Figure 37:
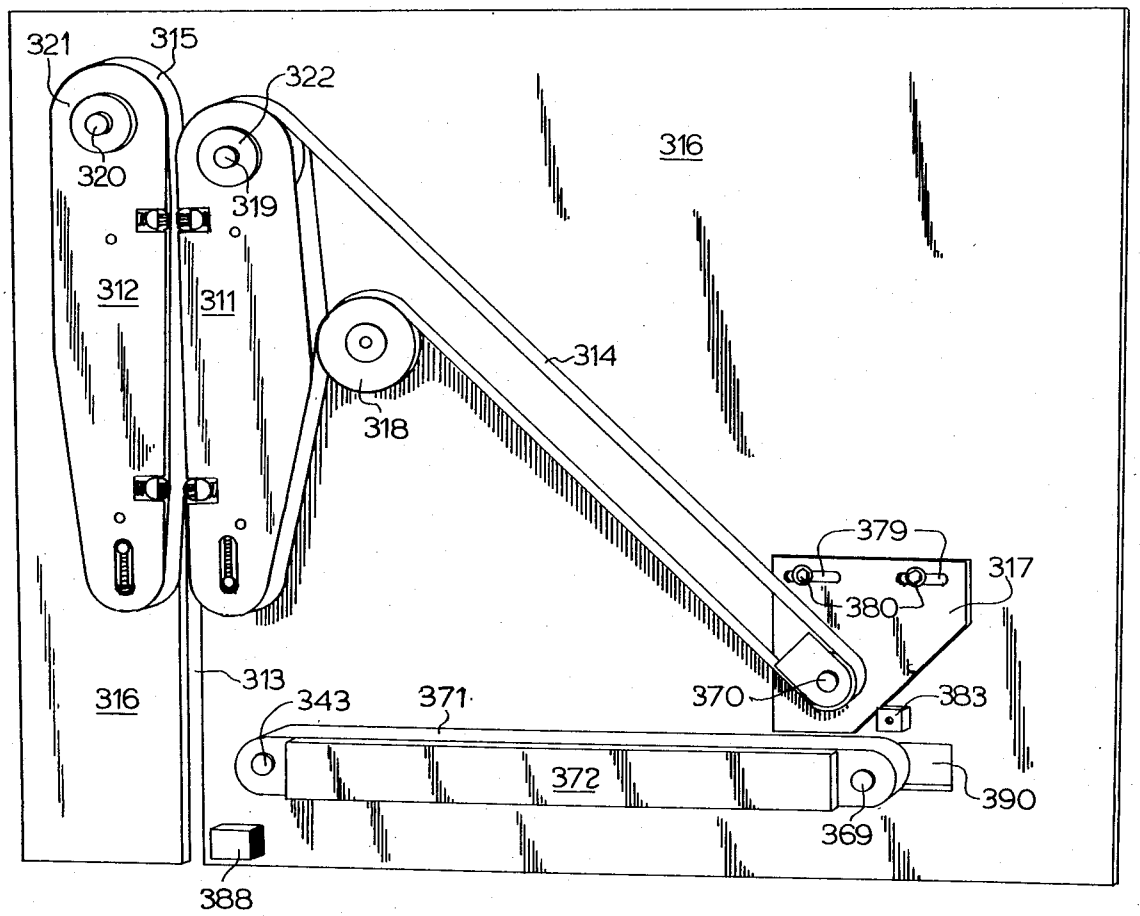
FIG. 37 is a front elevation of a second embodiment of a take-off mechanism that may be substituted for that apparatus shown in FIGS. 12 through 36(*b*), showing belt 371 in a retractable (first position).
Figure 41:
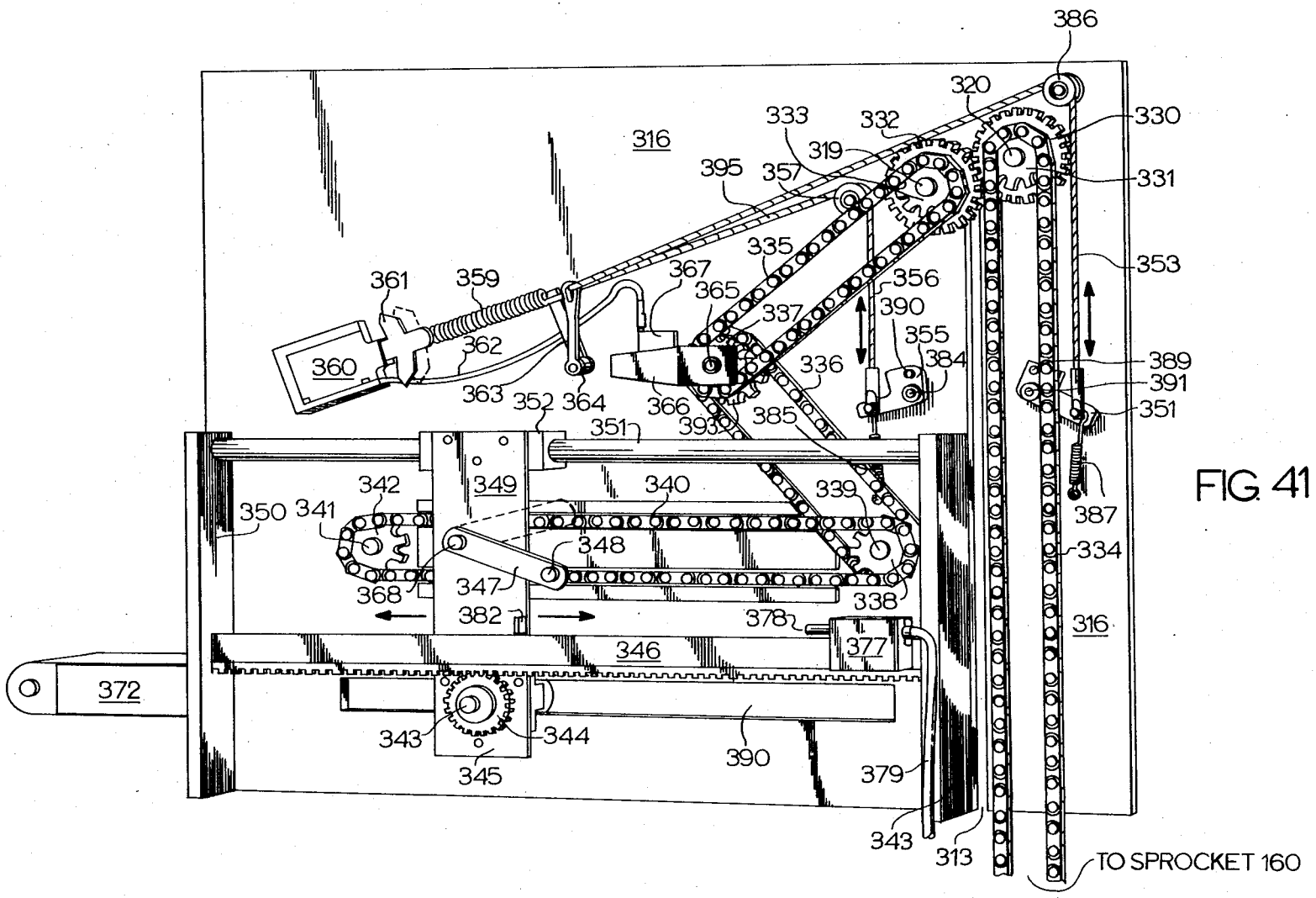
FIG. 41 is a front elevation of the apparatus used to drive and control the apparatus of FIGS. 37 and 38.
Figure 43:
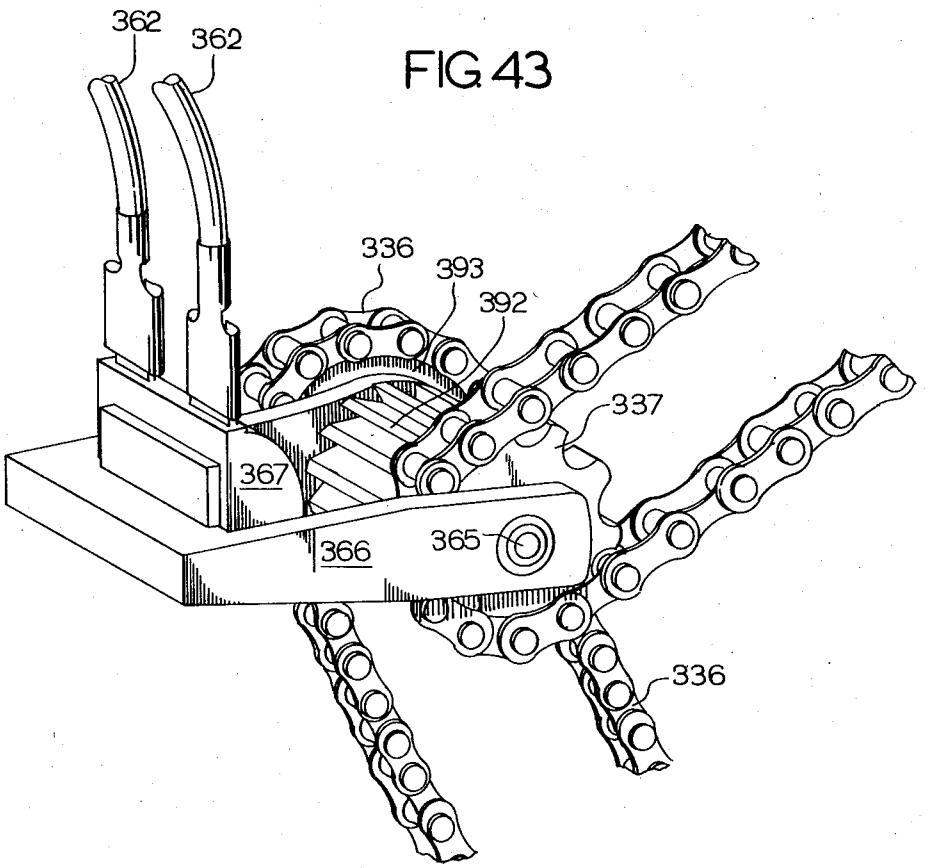
FIG. 43 is a perspective view of clutch 366 of FIG. 41.

Reference is now nade to FIG. 41, which shows the apparatus on the back side of base 316 for driving and controlling the apparatus as shown in FIG. 37. Chain 334 is threaded over sprocket 160 (FIG. 13) and sprocket 331. Sprocket 331 drives gear 330 which in turn drives gear 332 and thus sprocket 333. Sprocket 331 and gear 330 are affixed to axle 320, which is journaled in base 316. Gear 332 and sprocket 333 are affixed to axle 319, which is journaled in base 316. Chain 335 is threaded over sprokets 333 and 337. Sprocket 337 is affixed to axle 365, journaled in base 316. Also affixed to axle 365 is ratchet 392 and sprocket 393 (see FIG. 43). Chain 336 is threaded over sprockets 393 and double sprocket 338, the last named double sprocket being affixed to axle 339 journaled in base 316. Sprocket 338 is a double sprocket (two in number, both affixed to the same axle 339. Chain 340 is threaded over one of the two sprockets 338 and sprocket 342. Sprocket 342 is affixed to axle 341, journaled in base 316. Chain 335 runs continuously; therefore, all other chains also run continuously that are attached thereto subject to and contingent upon clutch 366. Axle 320 drives remover 312 and axle 319 powers remover 311, as well as belt 314. Through chains 335, 336 and 340, the reciprocating motion of belt 371 is provided in a yet-to-be-described manner.

Panel 349 is slideably affixed to cross rod 351 by means of block 352, affixed to panel 349. On a terminal portion of panel 349, there is disposed axle 343 on to which gear 344 is affixed. Gear 344 is a pinion gear and is in meshing engagement with rack gear 346, which is affixed to frames 350 and 343. Pinion gear 344 and axle 343 drive belt 371 from its previously described first to a second, then from its second to a first position and also rotate same as will be later described. Lever 347 is rotatively affixed to chain 340 through element 348 and likewise affixed to panel 349 through element 368. Also affixed to panel 349 is stop 382, which is in alignment with element 378 of switch 377. As panel 349 traverses left and right, as more fully explained later, lever 347 goes from a first (solid) to a second position (dotted lines) thus creating a reciprocating motion which, through panel 349 and axle 343, is imparted to belt 371.

Figure 42:
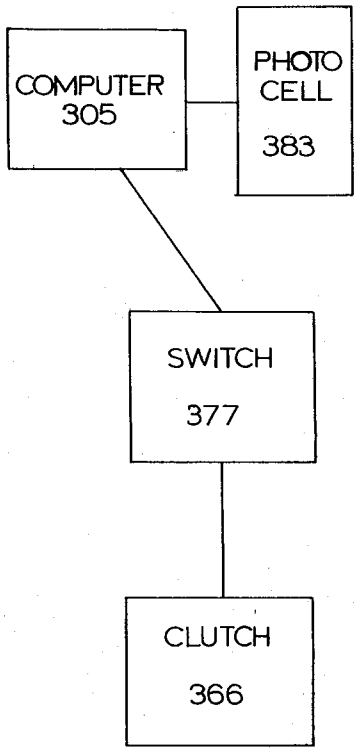
FIG. 42 is a schematic electric circuit controlling the reciprocating and rotating elevation of belt 371 of FIGS. 37 and 38.

Photo cell 388 is located on base 316 at the location shown in FIG. 37 and is in electrical communication (not shown) with computer 305 (see FIG. 42). Computer 305 is in electrical communication with switch 377 and switch 377 is in electrical communication with clutch assembly 366.

Solenoid 360 and its plunger 361 (an activator), through spring 359, is connected to ropes 353 and 395. Rope 395 is threaded through moveable yoke 364 (note arms 363), over pulley 357 and attached to rocker arm 355. Rocker arm 355 is pivotally mounted on base 316 by element 384, and is spring biased to a first position by spring 385 and affixed to remover 311 by pin 390. Rope 353 is likewise threaded through moveable yoke 364, over pulley 386 and affixed to rocker arm 351, which is pivotally mounted to base 316 by element 391. Rocker arm 355 is affixed to remover 312 by element 390, and is adapted to be rotated by rope 395 in the clockwise direction. Since it is physically attached to remover 311 (through an unshown slot in base 316), it is also adapted to move remover 311 (about axle 319) in a clockwise direction. The same is true for rocker arm 351 and rope 353, except that the direction of rotation is counterclockwise and rocker arm 351 is attached to remover 312. Thus, upon activation of solenoid 360, removers 311 and 312 converge (see FIG. 46) to remove sock 9 as described previously.

Referring to FIG. 37, a sensor 388 is shown (which could be a photocell or an infra-red means) which is in electrical communication (see element 322) with solinoid 360. Sensor 388 has two beams (not shown), one beam detects the presence or absence of a sock 9 on board 6. If there is no sock, nothing happens because one does not want belts 314 and 315 coming in contact with heated form 6. Such would damage the belts. If the first beam detects a sock, then the second beam is rendered activable The second beam senses size and height of board 6 (various sizes and board heights could be used) and if such is within a predetermined range of heights and sizes, then a signal is sent to solenoid 360 via an electrical conductor (see element 362) connecting sensor 388 with solenoid 360. Upon activation, solenoid 360 causes plunger 361 to move inwardly, thus rotating rocker arms 355 and 351 in the previously described manner causing the removers to converge and strip a sock. Once the sock is stripped, the conditions for actuating sensor 388 and solenoid 360 are removed, (removal of the sock) and thus solenoid 360 is deactivated. Plunger 361, via spring 359, is thus pulled outwardly, thereby allowing springs 385 and 386 to rotate dogs 355 and 351 respectively, back to their normal positions, i.e., removers 311 and 312 are in the open position.

Photocell 383 detects the presence of a sock 9 as it is about to leave belt 314 and be deposited on belt 371 (see FIGS. 44 through 50). Upon such detection, a signal is sent by conductor 362 from sensor 383 to clutch solenoid 367, but for clutch 366, chain 336 would run continuously. With clutch 366 engaged, chain 336 is driven. Clutch 366 is normally in an engagement mode. Upon receipt of the aforementioned signal from sensor 383, a paw (not shown) disengages itself from pinion gear 392 causing rotation of sprocket 393 and chain 336. This action causes rotation of chain 340 and thus causes movement of panel 349 from a first to a second and from a second to a first position. When stop 382 hits switch 377 (which is in the normally closed or "on" position), it depresses element 378 and causes switch 377 to go to the open or "off" state for about 4.5 seconds. Switch 377 is a switch like that switches 211 and 207, as previously described and operates in the same manner. See, for example, FIG. 32. After the expiration of the 4.5 seconds, it "times back", i.e., returns to the "on" position. However, by that time, computer 305 has already opened its contacts (as previously described) so that the circuit is deactivated until another sock activates photocell 383.

Figure 48:
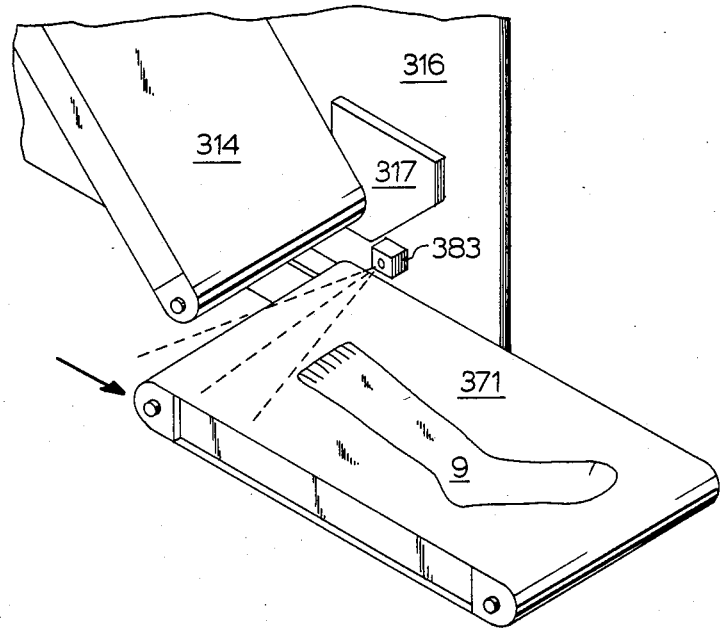

Gear 344 has a one directional drive bearing (not shown). Since the one directional drive gear bearing is designed to drive (rotate in a clockwise fashion) axle 343 only while panel 349 (and belt 371) is going from a second to a first position, i.e., from an extended (FIG. 38) to a retracted position (FIG. 37), belt 371 rotates around axles 368 and 369 only during its travel from such second to the first position. This action causes sock 6 to be discharged off of belt 372 onto a conveyor, or other receiver 391 as depicted in FIGS. 48 and 49.

What is claimed is:

1. An apparatus for drying flaccid articles on a boarding form and removing the flaccid articles from the boarding form comprising:

(a) a heating chamber having first and second slit-like openings;

(b) first, second, third and fourth tracks for receiving, transporting and discharging a form carrier, the first track being a continuous track disposed in the heating chamber and having at least one receiver thereon and the second, third and fourth tracks are disposed outside of the heating chamber; the second track being aligned with the first slit and having a channel to receive a form carrier from the first track and transport it to the third track; the third track having a receiver thereon to receive a form carrier and transport same to the fourth track; the fourth track being aligned with the second slit and having a channel thereon to receive a form carrier from the reciever of the third track and discharge same through the second slit to the receiver of the first track.

2. The apparatus of claim 1 including a flaccid article remover disposed outside of the heating chamber.

3. The apparatus of claim 2 including at least one form carrier and a boarding form thereon adapted to receive and hold upright a flaccid article;

4. The apparatus of claim 2 wherein the flaccid article remover comprises:

(a) a grasper disposed above the second tract for grasping and removing a flaccid object from the boarding form adapted to release said flaccid object onto a continuous belt;

(b) a moving device attached to the grasping device for moving the grasper from a first to a second position and then from said second to said first position;

(c) a first continuous belt adapted to be periodically rotated disposed below the aforementioned second position of the grasper for receiving and conveying flaccid articles to a tray; and (d) a tray disposed beneath the first continuous belt and a reciprocator attached thereto adapted to reciprocate the tray from a retracted to an extended position and then from the extended to the retracted position;

(e) a flat receiver disposed beneath the tray for receiving a predetermined number of flaccid articles from said tray while the tray is in its extended position; and, (f) a counter for determining the number of flaccid articles disposed disposed on the flat receiver.

5. The apparatus of claim 4 including a holder positioned above one terminal end portion of the tray at its extended position, the holder extendable in response to the tray being moved to its extended position to momentarily hold one terminal portion of the flaccid article stationary and retractable in response to the tray means being moved to its retracted position.

6. The apparatus of claim 5 wherein the holder includes an elongated rod one end of which is attached to the tray and the tray has a slot in one terminal portion thereof.

7. The apparatus of claim 4 wherein the flat receiver includes a first mover responsive to the deposition on the flat receiver of a stack of flaccid articles to move the flat receiver a predetermined horizontal distance in a direction essentially perpendicular with the longitudinal axis of the tray, a second mover responsive to the deposition on the flat receiver of a predetermined number of stacks of the flaccid articles to rotate the flat receiver ninety degrees in a horizontal plane, and a third mover responsive to the number of stacks of flaccid articles on the flat receiver to move the flat receiver downward a predetermined distance.

8. The apparatus of claim 7 wherein the flat receiver includes a power remover for removing power from the first, second, third and fourth tracks when the flat receiver achieves a predetermined position.

9. The apparatus of claim 10 wherein the flat receiver includes a power restoring means for restoring power to the first, second, third and fourth tracks when the flat receiver achieves a predetermined position.

10. The apparatus of claim 7 wherein the flat receiver includes a fourth mover for moving the flat receiving means in a upward direction.

11. The apparatus of claim 4 wherein the moving device is composed of a first continuous chain threaded over a plurality of sprockets and a tie rod affixed to the chain, the tie rod adapted to be moved from a first position to dispose the grasping device above the second track and thence to a second position to dispose the grasping device over the continuous belt.

12. The apparatus of claim 11 wherein the moving device includes a second continuous chain and additional sprockets, the second continuous chain being threaded over the additional sprockets and affixed to the tie rod, the additional sprockets being so disposed relative to one another that they cause the additional chain to define an oblong path the longitudinal axis of which is essentially parallel to the longitudinal axis of the tie rod.

13. The apparatus of claim 4 wherein the grasper is composed of a base, first and second upright members affixed to the base, an axle journaled in the upright members, a paw affixed to the axle, a slot in the base, a movable rack gear disposed in the slot, a pinion gear affixed to the axle and intermeshed with the rack gear and a biasing device affixed to the axle and to the base to bias the paw to a position in contact with the base.

14. The apparatus of claim 13 wherein the grasper includes a latch on the rack gear to temporarily affix the rack gear to the base when the rack gear is in a predetermined position.

15. The apparatus of claim 4 wherein the reciprocator includes a plurality of sprockets, a chain affixed to the tray threaded over the sprockets and disposed essentially parallel to the tray, the tray having at least one laterally extending stud affixed thereto, a slide bar with at least one slot therein threaded over the laterally extended stud of the tray and first and second upstanding members, the slide bar being movable from a first to a second and from the second to the first position delimited by the length of the slot therein, an elongated cable member affixed to the slide bar extendable and retractable therewith from the slide bar's first to the second and from the second to the first position, and the tray having affixed thereon a cross member in alignment with and in between the first and second upstanding members of the slide bar and adapted to abut thereagainst and move the tray from the first to the second and them from the second to a first position.

16. The apparatus of claim 15 including a drive to drive the chain in a first and then in a second direction.

17. The apparatus of claim 15 including a vertically disposed needle attached to a terminal portion of the cable, an arm in which the needle and a terminal portion of the cable are movably received and a slot in a terminal portion of the tray, the slot capable of being aligned with the needle when the tray is in its second position.

18. The apparatus of claim 17 including a photo counter attached to the arm, aligned with and spaced apart from the slot in the tray when the tray is in its second position.

19. The apparatus of claim 2 wherein the flaccid article remover comprises:

(a) a base; and, (b) second, third and fourth continuous rotable belts juxtaposed one to another and moveable from a first to a second position, the second position being such that the rotation of the second and third continuous rotatable belts is adapted to grasp and strip a flaccid article from a form and the fourth continuous portable belt is (i) disposed below the third continuous belt and adapted to be moved from a first to a second and then from the second to the first position and (ii) rotatable in a predetermined direction only when it travels from its second to its first position.

20. The apparatus of claim 19 including a sensor disposed near one terminal end portion of the third continuous rotatable belt.

21. The apparatus of claim 19 wherein one terminal end portion of the third continuous rotatable belt is disposed below one terminal end portion of the second continuous rotatable belt.

22. The apparatus of claim 19 including first and second elongated tracks wherein the second continuous rotatable belt is threaded over the first elongated track and a part of the third continuous rotatable belt is threaded over the second elongated track and both of the first and second elongated tracks are pivotably affixed to the base.

23. The apparatus of claim 22, wherein both of the first and second elongated tracks are affixed to a device on the base for moving the second and third continuous rotatable belts from said first to said second and from said second to said first position.

24. The apparatus of claim 23 wherein the device on the base for moving the juxtaposed second and third continuous rotatable belts from said first to a second and from said second to said first position comprises an actuator, a first rocker arm pivotably mounted to the base, attached to the first elongated track and responsive and affixed to the actuator and a second rocker arm pivotably mounted to the base, attached to the second elongated track and affixed to and responsive to the actuator.

25. The apparatus of claim 24 including a sensor disposed between the third continuous belt and the fourth continuous belt, the actuator being responsive to and in communication with the actuator.

26. The apparatus of claim 24 including a sensor attached to the base, a slot in the base disposed between the second and third continuous belts and the sensor is focused on a part of the slot, is in communication with the actuator and is adapted to activate said actuator in response to a flaccid article disposed on a form at a predetermined height being placed between the second and third continuous rotator belts.

27. The apparatus of claim 19 including a reciprocating device affixed to the base, a slot in the base, the reciprocating device being affixed to the fourth continuous rotatable belt through the slot and adapted to move the fourth continuous rotatable belt from said first to said second and from second to said first position.

28. The apparatus of claim 27 wherein the reciprocating device includes a pinion gear having a one directional drive in communication with the fourth continuous rotatable belt and a rack gear, said rack gear being in engagement with the pinion gear and a driving device for moving the pinion gear from the first to the second and from the second to the first position of the fourth continuous rotatable belt.

29. The apparatus of claim 28 wherein the one directional drive of the pinion gear is adapted to rotate the fourth continuous belt only when the fourth continuous rotatable belt is moving from the second to the first position.

30. The apparatus of claim 19 including a slot in the base, said second continuous rotatable belt being disposed on one side and the third continuous rotatable belt being disposed on the other side of the slot.

31. The apparatus of claim 1 wherein the receiver of the first track is a tube like member.

32. The apparatus of claim 1 wherein the receiver of the third track is a yoke shaped.

33. The apparatus of claim 1 wherein the first track comprises first and second sprocket, a continuous chain, the continuous chain being threaded over the sprockets and a plurality of tube like receivers affixed to the chain.

34. The apparatus of claim 1 wherein the second and fourth tracks each have a channel composed of parallel disposed spaced apart elongated members each having at least one inwardly protruding member, first and second sprockets and a continuous chain threaded thereover, each of the chains containing a plurality of upstanding protrusions thereon in a spaced apart relationship, the spaced apart relationship being such so that one of the upstanding protrusions is adapted to engage a form carrier disposed in the receiver of the first track, strip it therefrom and insert it and transport it along in the channel of the second track and thereafter strip the form carrier from the channel of the second track and deposit it into the receiver of the third track and the protrusions of the fourth track are adapted to engage a form carrier in the receiver of the third track, strip it therefrom, deposit it in and transport it along the channel of the fourth track and thereafter strip the form carrier from the last mentioned channel and deposit it in the receiver of the first track.

35. The apparatus of claim 1 wherein the third track comprises a continuous chain having a plurality of laterally extending spaced apart protrusions thereon, a plurality of forked receivers, a chain guide, and an actuator having an upstanding protrusion thereon, wherein the chain is threaded over the chain guide so that its longitudinaly axis is essentially perpendicular to the second and third tracks, the forked receiver are attached to the chain so that the longitudinal axis of the forked receiver may be aligned with the channel of the second and fourth tracks to receive a form carrier therefrom as such are conveyed from the second to the third track and from the third to the fourth track, the upstanding protrusion being positioned to be in removable engagement with the spaced apart laterally extending protrusions of the chain and the actuator being periodically activatable to periodically retract and then abut against the upstanding protrusion on the chain to periodically advance the chain a predetermined distance.

36. The apparatus of claim 35 wherein the second and fourth tracks each have a channel composed of parallel disposed spaced apart elongated members each having at least one inwardly protruding member, first and second sprockets and a continuous chain threaded thereover, each of the chains containing a plurality of upstanding protrusions thereon in a spaced apart relationship, the spaced apart relationship being such so that one of the upstanding protrusions is adapted to engage a form carrier disposed in the receiver of the first track, strip it therefrom and insert it in and transport it along the channel of the second track and thereafter strip the form carrier from the channel of the second track and deposit it into the receiver of the third track and the protrusions of the fourth track are adapted to engage a form carrier in the receiver of the third track, strip it therefrom and deposit it in and transport it along the channel of the fourth track and thereafter strip the form carrier from the last mentioned channel and deposit in the receiver of the first track.

37. The apparatus of claim 35 wherein the first track comprises first and second sprocket means, a continuous chain threaded over the sprockets and a plurality of tube like form carriers affixed to said chain.

38. The apparatus of claim 35 wherein the receiver of the first track is a tube like member.

39. The apparatus of claim 35 wherein the accuator includes a disk, a push rod, a slide bar and a block having an aperture therein on which the upstanding protrusion is rotatably affixed thereto so that it rotates in one but not a reverse direction, wherein the disk is off center affixed to the push rod and the push rod is rotatably affixed to the block, the slide bar is spaced apart from and affixed to the chain guide and the block is slideably threaded onto the slide bar through the aperture.

40. The apparatus of claim 1 wherein the heating chamber includes a heating source, a first fan and a first duct, the first duct being in communication with the interior of the heating chamber, the heating source and the first fan.

41. The apparatus of claim 40 wherein the heating chamber includes a second duct and a second fan, the second duct being in communication with the interior of the heating chamber the second fan and the heating means.

42. The apparatus of claim 40 wherein the heating chamber includes a duct in communication with the interior of the heating chamber and the atmosphere outside of the heating chamber.

43. A method of conveying a sock into and out of a heating chamber while on a boarding form and removing same comprising:

(a) providing a heating chamber with first and second openings therein, first, second, third and fourth tracks, the first track being continuous in nature and disposed in the heating chamber and the second, third and fourth tracks being linear in nature, disposed outside of the heating chamber and adapted to receive and transport a form carrier, and a boarding form attached to the form carrier;

(b) disposing a sock on the boarding form while the boarding form and form carrier is at a first position on the fourth track;

(c) transporting the form carrier, boarding form and sock from the first position on the fourth track through the second opening in the heating chamber onto the first track and thence from the first track to the second track and thereafter to a second position;

(d) removing the sock from the boarding form at the second position;

(e) transporting the form carrier and boarding form from the second position by the second tract to the third track;

(f) transporting the form carrier and boarding form over the third track to the fourth track; and, (g) transporting the form carrier and boarding form over the fourth track to the first position.

44. The method of claim 43 wherein heat is applied to the sock within the heating chamber.

45. The method of claim 43 wherein the direction of travel of the second and fourth tracks is essentially perpendicular to the direction of travel of the third track.

46. The method of claim 43 wherein the sock is removed from the boarding form at the second position by grasping the sock with a grasper and thereafter conveying the sock by the grasper to a first conveyor and depositing the sock thereon.

47. The method of claim 46 including the step of returning the grasper to a position to grasp another sock at the second position after the grasper has deposited a sock on the first conveyor.

48. The method of claim 47 including the step of depositing two socks in essentially simultaneously fashion on the first conveyor.

49. The method of claim 46 wherein after the sock is removed from the boarding form at the second position including the further step of depositing the sock on another rotatable conveyer and then moving said another rotatable conveyer from a first to a second and then from the second to the first position.

50. The method of claim 49 including the step of rotating said another conveyer only while it travels from the second to the first position.

51. The method of claim 43 including the steps of conveying the sock on the first conveyor and depositing the sock on a tray.

52. The method of claim 51 including the steps of positioning the tray over a flat receiver and then stripping the sock from the tray and depositing the sock on the flat receiver.

53. The method of claim 52 including the steps of returning the grasper from the position where it deposits the sock on the first conveyer to the position where it removed the sock from the boarding form substantially simultaneously with depositing a sock by the first conveyor on the flat receiver.

54. The method of claim 53 including the steps of moving the flat receiver in a horizontal direction after the deposition of a stack of socks thereon a distance sufficient to expose space on the flat receiver to receive another stack of socks and thereafter repeating the aforesaid steps of sock deposition and moving until the flat receiver has received thereon more than one stack of socks.

55. The method of claim 54 including the step of moving the flat receiver in a vertical downward direction a predetermined distance after a predetermined number of stacks of socks have been deposited on the flat receiver.

56. The method of claim 55 including the step of rotating the flat receiver 90° about its vertical axis after a predetermined number of stacks of socks have been deposited on it.

57. The method of claim 56 including the step of deositing a plurality of stacks of socks on top of the first mentioned stacks of socks so that the longitudinal axis of the socks in the first mentioned stack of socks are essentially 90° to the like axis of the second mentioned stack of socks.

58. An apparatus for removing a flaccid article from a boarding form comprising:

(a) a base; and, (b) second, third and fourth continuous rotable belts juxtaposed one to another and moveable from a first to a second position, the second position being such that the rotation of the second and third continuous rotatable belts is adapted to grasp and strip a flaccid article from a form and the fourth continuous belt is (i) disposed below the third continuous belt and adapted to be moved from a first to a second and then from the second to the first position and (ii) rotatable in a predetermined direction only when it travels from its second to its first position.

59. The apparatus of claim 58 including a sensor disposed near one terminal end portion of the third continuous rotatable belt.

60. The apparatus of claim 58 including first and second elongated tracks wherein the second continuous rotatable belt is threaded over the first elongated track and a part of the third continuous rotatable belt is threaded over the second elongated track and both of the first and second elongated tracks are pivotably affixed to the base.

61. The apparatus of claim 60 wherein both of the first and second elongated tracks are affixed to a means on the base for moving the second and third continuous rotatable belts from said first to said second and from said second to said first position.

62. The apparatus of claim 61 wherein the device on the base for moving the juxtaposed second and third continuous rotatable belts from said first to a second and from said second to said first position comprises an actuator a first rocker arm pivotably mounted to the base, attached to the first track and affixed to and responsive to the actuator, and a second rocker arm pivotably mounted to the base, attached to the second elongated track and affixed to and responsive to the actuator.

63. The apparatus of claim 62 including a sensor disposed between the third continuous belt and the fourth continuous belt, the actuator being responsive to and in communication with the actuator.

64. The apparatus of claim 58 including a reciprocating device affixed to the base, a slot in the base, the reciprocating device being affixed to the fourth continuous rotatable belt through the slot and adapted to move the fourth continuous rotatable belt from said first to said second and from second to said first position.

65. The apparatus of claim 64 including a sensor attached to the base, a slot in the base disposed between the second and third continuous belts and the sensor is focused on a part of the slot, is in communication with the actuator and is adapted to activate said actuator in response to a flaccid article disposed on a form at a predetermined height being placed between the second and third continuous rotatable belts.

66. The apparatus of claim 64 wherein the reciprocating device includes a pinion gear having a one directional drive in communication with the fourth continuous rotatable belt and a rack gear, said rack gear being in engagement with the pinion gear and a driving device for moving the pinion gear from the first to the second and from the second to the first position of the fourth continuous rotatable belt.

67. The apparatus of claim 66 wherein the one directional drive of the pinion gear is adapted to rotate the fourth continuous belt only when the fourth continuous rotatable belt is moving from the second to the first position.

68. The apparatus of claim 58 including a slot in the base, said second continuous rotatable belt being disposed on one side and the third continuous rotatable belt being disposed on the other side of the slot.

69. An apparatus for removing a flaccid article from a boarding form comprising:

(a) a grasper disposed above the second tract for grasping and removing a flaccid object from the boarding form adapted to release said flaccid object onto a continuous belt;

(b) a moving device attached to the grasping device for moving the grasper from a first to a second position and then from said second to said first position;

(c) a first continuous belt adapted to be periodically rotated disposed below the aforementioned second position of the grasper for receiving and conveying flaccid articles to a tray; and (d) a tray disposed beneath the first continuous belt and a reciprocator attached thereto adapted to reciprocate the tray from a retracted to an extended position and then from the extended to the retracted position;

(e) a flat receiver disposed beneath the tray for receiving a predetermined number of flaccid articles from said tray while the tray is in its extended position; and, (f) a counter for determining the number of flaccid articles disposed disposed on the flat receiver.

70. The apparatus of claim 69 including a holder positioned above one terminal end portion of the tray at its extended position, the holder extendable in response to the tray being moved to its extended position to momentarily hold one terminal portion of the flaccid article stationary and retractable in response to the tray means being moved to its retracted position.

71. The apparatus of claim 70 wherein the holder includes an elongated rod one end of which is attached to the tray and the tray has a slot in one terminal portion thereof.

72. The apparatus of claim 69 wherein the flat receiver includes a first mover responsive to the disposition on the flat receiver of a stack of flaccid articles to move the flat receiver a predetermined horizontal distance in a direction essentially perpendicular with the longitudinal axis of the tray, a second mover responsive to the deposition on the flat receiver of a predetermined number of stacks of the flaccid articles to rotate the flat receiver ninety degrees in a horizontal plane, and a third mover responsive to the number of stacks of flaccid articles on the flat receiver to move the flat receiver downward a predetermined distance.

73. The apparatus of claim 72 wherein the flat receiver includes a fourth mover for moving the flat receiving means in a upward direction.

74. The apparatus of claim 69 wherein the flat receiver includes a power remover for removing power from the first, second, third and fourth tracks when the flat receiver achieves a predetermined position.

75. The apparatus of claim 74 wherein the flat receiver includes a power restoring means for restoring power to the first, second, third and fourth tracks when the flat receiver achieves a predetermined position.

76. The apparatus of claim 69 wherein the moving device is composed of a first continuous chain threaded over a plurality of sprockets and a tie rod affixed to the chain, the tie rod adapted to be moved from a first position to dispose the grasping device above the second track and thence to a second position to dispose the grasping device over the continuous belt.

77. The apparatus of claim 76 wherein the moving device includes a second continuous chain and additional sprockets, the second continuous chain being threaded over the additional sprockets and affixed to the tie rod, the additional sprockets being so disposed relative to one another that they cause the additional chain to define an oblong path the longitudinal axis of which is essentially parallel to the longitudinal axis of the tie rod.

78. The apparatus of claim 69 wherein the grasper is composed of a base, first and second upright members affixed to the base, an axle journaled in the upright members, a paw affixed to the axle, a slot in the base, a movable rack gear disposed in the slot, a pinion gear affixed to the axle and intermeshed with the rack gear and a biasing device affixed to the axle and to the base to bias the paw to a position in contact with the base.

79. The apparatus of claim 78 wherein the grasper includes a latch on the rack gear to temporarily affix the rack gear to the base when the rack gear is in a predetermined position.

80. The apparatus of claim 69 wherein the reciprocator includes a plurality of sprockets, a chain affixed to the tray threaded over the sprockets and disposed essentially parallel to the tray, the tray having at least one laterally extending stud affixed thereto, a slide bar with at least one slot therein threaded over the laterally extended stud of the tray and first and second upstanding members, the slide bar being movable from a first to a second and from the second to the first position delimited by the length of the slot therein, an elongated cable member affixed to the slide bar extendable and retractable therewith from the slide bar's first to the second and from the second to the first position, and the tray having affixed thereon a cross member in alignment with and in between the first and second upstanding members of the slide bar and adapted to abut thereagainst and move the tray from the first to the second and them from the second to a first position.

81. The apparatus of claim 80 including a drive to drive the chain in a first and then in a second direction.

82. The apparatus of claim 80 including a vertically disposed needle attached to a terminal portion of the cable, an arm in which the needle and a terminal portion of the cable are movably received and a slot in a terminal portion of the tray, the slot capable of being aligned with the needle when the tray is in its second position.

83. The apparatus of claim 82 including including a photo counter attached to the arm, aligned with and spaced apart from the slot in the tray when the tray is in its second position.

84. A method of removing a sock from a boarding form comprising the steps of grasping a sock on a boarding form at a first position with a gasper and thereafter conveying the sock by the grasper to a first conveyer and depositing the sock thereon and then, returning the grasper to the first position to grasp another sock and conveying the sock on the first conveyer and thereafter depositing the sock on a tray.

85. The method of claim 84 including the steps of positioning the tray over a flat receiver and then stripping the sock from the tray and depositing the sock on the flat receiver.

86. The method of claim 85 including the steps of returning the grasper from the position where it deposits the sock on the first conveyer to the position where it removed the sock from the boarding form substantially simultaneously with depositing a sock by the first conveyor on the flat receiver.

87. The method of claim 86 including the steps of moving the flat receiver in a horizontal direction after the deposition of a stack of socks thereon a distance sufficient to expose space on the flat receiver to receive another stack of socks and thereafter repeating the aforesaid steps of sock deposition and moving until the flat receiver has received thereon more than one stack of socks.

88. The method of claim 87 including the step of moving the flat receiver in a vertical downward direction a predetermined distance after a predetermined number of stacks of socks have been deposited on the flat receiver.

89. The method of claim 88 including the step of rotating the flat receiver 90° about its vertical axis after a predetermined number of stacks of socks have been deposited on it.

90. The method of claim 89 including the step of depositing a plurality of stacks of socks on top of the first mentioned stacks of socks so that the longitudinal axis of the socks in the first mentioned stack of socks are essentially 90° to the like axis of the second mentioned stack of socks.

91. A method of removing a sock from a boarding form comprising:

(a) positioning the boarding form with a sock disposed thereon between first and second rotatable continuous belts;

(b) bringing the first and second continuous rotatable belts in contact with the sock;

(c) removing the sock from the boarding form by rotating the first and second continuous rotatable belts; and (d) conveying the sock to and depositing the sock on a third continuous belt by the second continuous rotatable belt, while said third continuous rotatable belt is in a first position.

92. The method of claim 91 including the steps of moving the third continuous rotatable belt from a first to a second position after a sock is deposited on the third continuous rotatable belt.

93. The method of claim 92 including the step of moving the third continuous rotatable belt from the second position to the first position and rotating the third continuous belt only while it is being moved from the second to the first position.

* * * * *